US006807698B2

(12) United States Patent
Torbet et al.

(10) Patent No.: US 6,807,698 B2
(45) Date of Patent: Oct. 26, 2004

(54) BED HAVING LOW BODY PRESSURE AND ALIGNMENT

(75) Inventors: Philip Alan Torbet, San Rafael, CA (US); Roger Anton Sramek, Sausalito, CA (US); David Steven Perry, Sausalito, CA (US)

(73) Assignee: SleepAdvantage, LLC, Sausalito, CA (US)

( * ) Notice: Subject to any disclaimer, the term of this patent is extended or adjusted under 35 U.S.C. 154(b) by 38 days.

(21) Appl. No.: 10/160,542

(22) Filed: Jun. 1, 2002

(65) Prior Publication Data

US 2003/0221261 A1 Dec. 4, 2003

(51) Int. Cl.[7] ..... A47C 27/15; A47C 27/18; A47C 27/10

(52) U.S. Cl. ..... 5/727; 5/730; 5/710; 5/713

(58) Field of Search ..... 5/727, 730, 738, 5/728, 713, 710

(56) References Cited

U.S. PATENT DOCUMENTS

| | | | | | |
|---|---|---|---|---|---|
| 3,521,311 | A | * | 7/1970 | Cohen | 5/727 |
| 3,828,378 | A | * | 8/1974 | Flam | 5/730 |
| 3,885,258 | A | * | 5/1975 | Regan | 5/727 |
| 4,053,957 | A | * | 10/1977 | Regan | 5/727 |
| 4,110,881 | A | * | 9/1978 | Thompson | 5/730 |
| 4,662,012 | A | | 5/1987 | Torbet | |
| 4,706,313 | A | * | 11/1987 | Murphy | 5/738 |
| 4,771,495 | A | | 9/1988 | Distler et al. | |
| 4,918,773 | A | | 4/1990 | Scott | |
| 4,972,536 | A | | 11/1990 | Scott | |
| 4,982,466 | A | | 1/1991 | Scott et al. | |
| 4,986,738 | A | | 1/1991 | Kawasaki et al. | |
| 5,101,527 | A | * | 4/1992 | Wadsworth, III et al. | 5/727 |
| 5,134,735 | A | | 8/1992 | Rose | |
| 5,160,785 | A | | 11/1992 | Davidson, Jr. | |
| 5,184,802 | A | | 2/1993 | Galumbeck | |
| 5,230,110 | A | | 7/1993 | Rose | |
| 5,231,717 | A | | 8/1993 | Scott et al. | |
| 5,317,768 | A | | 6/1994 | Klancnik | |
| 5,430,901 | A | * | 7/1995 | Farley | 5/727 |
| 5,987,678 | A | | 11/1999 | Ayers | |
| 6,115,861 | A | * | 9/2000 | Reeder et al. | 5/727 |
| 6,202,239 | B1 | | 3/2001 | Ward et al. | |
| 6,223,371 | B1 | * | 5/2001 | Antinori et al. | 5/727 |
| 6,372,812 | B1 | | 4/2002 | Niederost | |

FOREIGN PATENT DOCUMENTS

| | | | | |
|---|---|---|---|---|
| WO | WO 81/02384 | * | 9/1981 | 5/727 |

* cited by examiner

*Primary Examiner*—Alexander Grosz
(74) *Attorney, Agent, or Firm*—David E. Lovejoy

(57) ABSTRACT

A mattress for supporting a reclining body. The mattress includes a resilient top member having a top region possessing uniform displacement parameters and also includes resilient supporting means supporting the top member with variable displacement. The combination of members with uniform displacement parameters over members with variable displacement parameters enables the mattresses to support the body in alignment and with uniform low pressure.

63 Claims, 11 Drawing Sheets

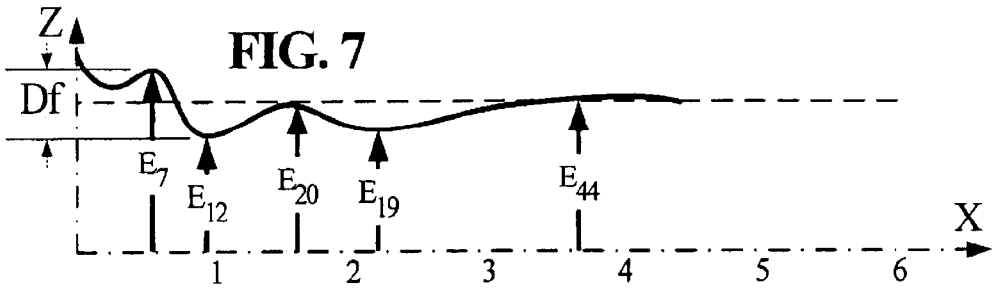
FIG. 7
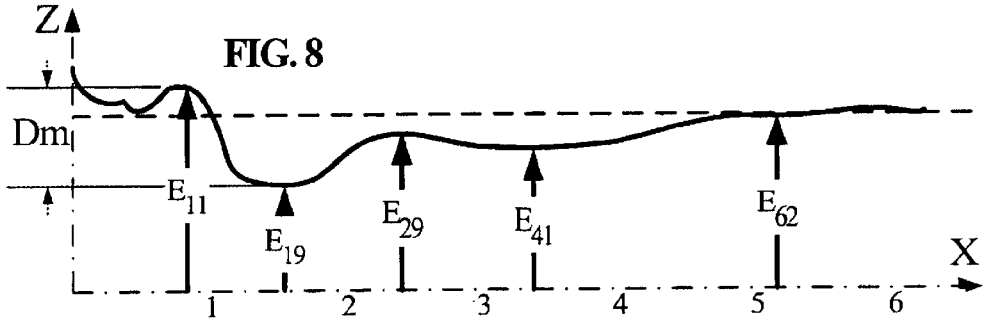
FIG. 8
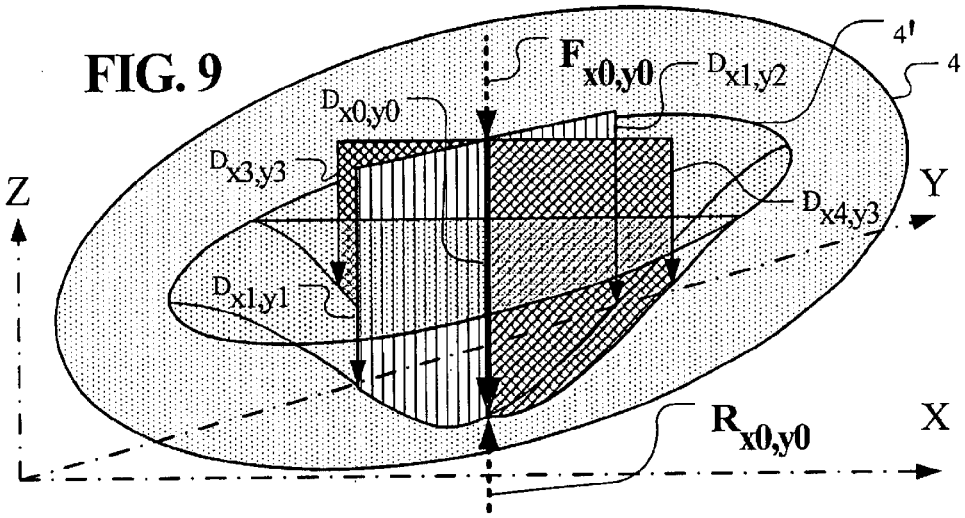
FIG. 9
FIG. 10
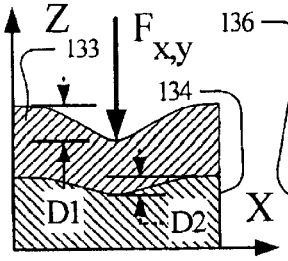
FIG. 11
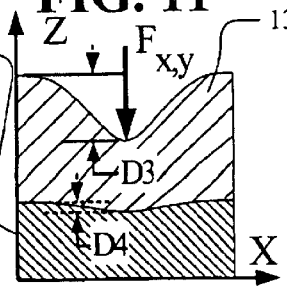
FIG. 12
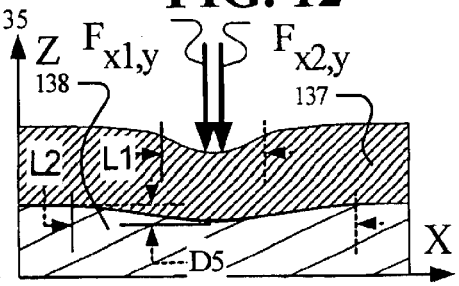

BED HAVING LOW BODY PRESSURE AND ALIGNMENT

BACKGROUND OF THE INVENTION

This invention relates to beds and, more particularly, to improved mattresses for beds that enhance the quality of sleep.

Normally, everyone spends a large percentage of everyday sleeping and the quality of sleep is important to a person's good health and enjoyment of life. Comfortable mattresses are important in establishing restful sleep. During sleep, a healthy person typically passes through five levels of sleep which are called stages I–IV and REM (Rapid Eye Movement) sleep. Stages I and II are the lightest sleep and stages III and IV are the deepest. The REM stage is that level in which sleepers dream and receive the mental health benefits attendant dreaming. All levels of sleep are important, but stages III and IV are the deepest and most physically restful sleep, when, for example, human growth hormone is secreted. Normal sleep is cyclic passing through the stages from I to IV and back from IV to I and into REM. This sleep cycle is repeated a number of times over a normal sleep period, but can be disrupted due, for example, to body discomfort.

Restfulness and the quality of sleep is dependent upon the comfort of sleepers. When sleepers become uncomfortable, they move to relieve the discomfort and the resulting moves are a normal part of sleep. When sleepers move, they frequently change to lighter levels of sleep (stage I or II) or awaken. The more discomfort sleepers feel, the more they will move and the more time they will spend in lighter and less restful sleep. Good sleeping is normally associated with a low number of body shifts during the sleep period. Bed-induced shifts due to discomfort caused by the bed are a significant cause of poor sleep quality. On conventional mattresses (including feather beds, inner spring mattresses, orthopedic mattresses, waterbeds and the like), most people experience about forty major postural body shifts in the course of a night's sleep. Poor sleepers experience about sixty percent more major shifts than good sleepers. While some shifts during a sleep period are beneficial, the quality of sleep can be greatly improved for many by reducing the number of bed-induced shifts.

There are two major causes of bed-induced shifting that cause poor sleep. The first major cause of shifting is the buildup of pressures on parts of the body and the second major cause of shifting is poor body alignment. Considering the first major cause of shifting, the buildup of pressures results from prolonged lying in the same position. On conventional mattresses, the pressure tends to be greatest on the body's protrusions (such as shoulders and hips) where body tissues are put in high compression against the mattress. High compression tends to restrict capillary blood flow which is recognized by the body, after a period of time, as discomfort. The pressure threshold which causes a discontinuance of capillary blood flow is called the ischemic pressure. The ischemic pressure is normally considered to be approximately thirty mmHg. The discontinuance of capillary blood flow is observable as a red spot on the skin. After pressure is applied, a red spot on the skin is a precursor to tissue damage. When parts of the body (usually shoulders and hips in conventional mattresses) are subjected to pressures above the ischemic threshold, discomfort results and, hence, a person shifts to remove the discomfort and threat to tissue damage.

Considering the second major cause of shifting, poor body alignment results from lateral bending of the vertebral column of the body, particularly for a person in a side-sleeping position. Such lateral bending is typically caused by mattresses that allow sagging of the body. Conventional mattresses allow such sagging regardless of the hardness or the softness of the mattress but the sagging effect tends to be more pronounced on soft mattresses. A sagging mattress allows the waist to drop relative to the rib cage and hips and results in stress to muscles, tendons and ligaments. The stress from a sagging mattress frequently manifests as discomfort or even pain in the lumbar region of the back. Such discomfort causes the sleeper to shift in order to relieve the discomfort.

In U.S. Pat. No. 4,662,012 invented by Torbet, one of the inventors herein, an air mattress is disclosed for supporting a person in a reclining position while maintaining spinal alignment and while maintaining low supporting body surface pressure. The Torbet mattress utilized zones running laterally across the width of the mattress with differing air pressure in the zones longitudinally along the length of the mattress. The Torbet mattress has proved to be ideal for supporting sleepers while minimizing supporting body surface pressure and maintaining spinal alignment.

While the Torbet mattress has established a standard of comfort that has not been achieved by conventional mattresses, the Torbet mattress has not been distributed as widely as possible because of its high cost of manufacture. The superior benefits of the Torbet mattress have generally been available only to those, such as hospitals, sleep clinics and the wealthy, willing to pay a high price.

For the Torbet mattress and mattresses in general, persons of greater body weight tend to sink farther into and depress the mattress more than persons of lower body weight. Body protrusions (such as shoulders and hips) cause the highest depression of the mattress and need to be accommodated. The shoulder of a heavy body resting atop the mattress in a side-lying position should not bottom out, that is, the shoulder should not depress the mattress to the extent that an underlying hard supporting surface is felt.

Mattresses using foam and spring sections have been proposed to reduce the cost of the Torbet mattress. Foam or spring sections alone in mattresses, because of the vertical displacement properties of conventional foams and springs, have not satisfactorily achieved simultaneously spinal alignment and uniform low supporting body surface pressure along the interface between the mattress and the body.

An ideal mattress has a resiliency over the length of a body reclining on the mattress to support the body in spinal alignment, without allowing any part of the body to bottom out, and also has a low surface body pressure over all or most parts of the body in contact with the mattress. Since a reclining body has both varying density and varying contour in the longitudinal direction, the ideal mattress must conform to these variations. With such variations, in order to achieve spinal alignment, the supporting forces in the mattress, under load from the reclining body, must vary along the body to match the varying body density and shape. Also, when the body is in spinal alignment, in an ideal mattress, the supporting pressures in the mattress against the skin must be low. The preferred pressure against the skin of a person in bed for an ideal mattress is generally below the ischemic threshold. The preferred side-lying spinal alignment for a person in bed is generally defined as that alignment in which the spine is straight and on the same center line as the legs and head.

While the general principles of an ideal mattress have been recognized since the Torbet mattress, actual embodiments of mattresses that approach the properties of an ideal mattress at reasonable costs have not been forthcoming. Lateral zones, with varying compression in the longitudinal direction, of springs in spring mattresses are capable of achieving spinal alignment if the mattress is of sufficient depth to allow the shoulders and hips to sink into the mattress to a depth that maintains spinal alignment without bottoming out. However spring mattresses generally do not achieve spinal alignment for the primary reason that the compression forces in springs vary as a function of the vertical depression of the springs in compression. The taller the spring in the relaxed state, the greater is the vertical depression and compression of the spring before the force increases to balance the weight of the part of the body lying on the spring. Thus, a body can sink farther into a tall, weak spring before the weight of the body is balanced than it can sink into a short, firm spring. Although tall, weak compression springs are desirable for reducing body pressure, they tend to have intolerable lateral instability and other problems that result in uncomfortable mattresses.

Conventional single-layer spring mattresses with uniform springs are generally unable to provide the qualities necessary for an ideal mattress. In a two-layer structure, the spring compression rate is decreased if one compression spring in one layer is mounted atop another compression spring in another layer. U.S. Pat. No. 5,231,717 used the two-layer structure in multiple zones extending laterally, with different firmness in zones in the longitudinal direction, to provide bedding systems customized for each person in order to provide spinal alignment for each person's particular size and body density. However, such mattresses with different firmness sections in the top supporting layer (the supporting layer closest to the body) provide an irregular firmness that tends to disturb persons in bed.

While substitutes for the Torbet mattress have been attempted, conventional mattresses having zones made from springs and foam do not have the same properties as the air zones in the Torbet mattress. In a Torbet mattress, the force distribution in a zone as a result of vertical depression (caused by a body part such as a shoulder) tends to be distributed and averaged laterally over the entire zone. Because air is fluid, air pressure in a Torbet mattress tends to be averaged and equally distributed in a zone. By way of distinction, the lateral and longitudinal distribution of forces due to a body part depression (for example, from a shoulder) into foam is more local, more complex and is a function of the displacement properties of the particular foam material used. Simple foam and spring mattresses in single or multiple layers have not provided the comfort and other benefits of the Torbet mattress.

In addition to the technical parameters of ideal mattresses described above, many purchasers and merchants have come to expect beds to have other "standard properties". For example, an expectation is that mattresses will have standard sizes such as King, Queen, Double and so forth with dimensions that match existing fitted-sheet sizes, frame sizes and other bedding equipment sizes. Further, an expectation is that a mattress will be compatible with a two-part bed formed of a foundation and a mattress which together are suitable for use with standard frames, such as "Hollywood" or "Harvard" frames. Purchasers and merchants expect that a bed when made-up with sheets and blankets will appear flat and uniform. The public expects that a bed will have the support and rigidity suitable for a person to sit on the edge for tying shoes or to sit on the edge for other purposes. While these "standard properties" generally do not add to the suitability of the bed for sleeping, they are nonetheless important for widespread commercial acceptance of mattresses.

A number of additional "attributes" are also important for commercial acceptance of mattresses. A mattress design desirably meets the needs of a large percentage of the population. The greatest demand is for beds that sleep two people side by side where typically, one of the two is larger than the other. Mattress sizes desirably accommodate a large percentage of pairs of people (for example, a large man and a smaller woman) in the population. A large percentage of the population is between the measurements for a 97.5 percentile male Caucasian and a 2.5 percentile female Caucasian. While other ethnic body types may be larger or otherwise different in measurement, most of the size differences for different body types are manifested in the length of legs so that, for purposes of mattress sizing, the ethnic size differences of people tend not to be significant. Mattresses are desirably available as a single integrated package easily installed as part of a bed without need for many separate or custom parts that require tailoring or otherwise increase the complexity of bed distribution and assembly. The number of stocking numbers required for a mattress product line is desirably low so that distribution and sale is efficient. Typically, mattresses are marketable in a family of three consumer prices ranges, namely high, medium and low and it is commercially desirable to have a mattress line that is marketable in those different price ranges.

Developments in the parameters of and manufacturing capabilities for foam and other materials have provided new components for mattresses that can be used to better approach the technical parameters required for an ideal mattress at economical costs and which can be manufactured with expected "standard properties" and with the "attributes" for mattresses that are desired by the public.

In consideration of the above background, there is a need for improved mattresses that better approach the properties of ideal mattresses and that can be economically manufactured while satisfying the public expectations and demands for mattresses.

SUMMARY

The present invention is a mattress for supporting a reclining body. The mattress includes a resilient top member having a top region possessing uniform displacement parameters and also includes resilient supporting means supporting the top member with variable displacement parameters. The combination of members with uniform displacement parameters positioned over members with-variable displacement parameters enables the mattress to support the body in alignment and with uniform low pressure.

The mattress extends in a longitudinal direction, from a mattress head to a mattress foot, and extends in a lateral direction, normal to the longitudinal direction. The body to be supported includes a head part, a shoulder part, a waist part, a hip part and a leg part oriented from head to foot in the longitudinal direction. The mattress top member possesses uniform displacement parameters in the lateral and longitudinal directions. The resilient supporting means extends in the lateral direction and in the longitudinal direction with different displacement parameters in the longitudinal direction. The resilient supporting means coacts with the top member for establishing alignment of the body with uniform low supporting surface pressure on the body.

Both static and dynamic embodiments of mattresses are included within the scope of the present invention. In static embodiments, discrete or continuous foam members have different displacement parameters in the longitudinal direction. In one static embodiment, foam members with curving internal surfaces are combined to vary the displacement parameters in the longitudinal direction. The dynamic embodiments include adjustable lifts which adjust the elevation under foam members. Preferably, the lifts are adjusted using controlled air pressure from an air pump. The dynamic embodiments include one or more lifts located under one or more of the head, shoulder, waist, hip and leg sections of the mattress. Control units for sensing and controlling lift elevations and displacement parameters are provided.

In mattresses of the present invention, the pressure on the interface between the body and the mattress is established by the supporting forces from a combination of vertically stacked mattress members. In general, the mattress members have different displacement parameters and particularly have different resistance to compression. The resistance to compression for resilient foam materials is measured by an ILD (indentation load deflection) value. The elevation adjustments provided by the lifts enable the foam members to maintain their compression within a satisfactory operating range. In vertical stacks of resilient foam members, each foam member operates within its own satisfactory operating range. In some embodiments, a vertical slot is located between foam members to insure that the foam members are not compressed beyond their satisfactory operating ranges.

The foregoing and other objects, features and advantages of the invention will be apparent from the following detailed description in conjunction with the drawings.

BRIEF DESCRIPTION OF THE DRAWINGS

FIG. 7 depicts a vertical displacement in the Z-axis direction along the length of a mattress in the X-axis direction for the female on the mattress of FIG. 5.

FIG. 8 depicts a vertical displacement in the Z-axis direction along the length of a mattress in the X-axis direction for the male on the mattress of FIG. 6.

FIG. 9 depicts a vertical displacement of mattress foam material in the Z-axis direction along the length in the X-axis direction and along the width in the Y-axis direction.

FIG. 10 depicts a vertical displacement of mattress foam material in the Z-axis direction along the length in the X-axis direction for two layers of foam having the same resistance to vertical displacement.

FIG. 11 depicts a vertical displacement of mattress foam material in the Z-axis direction along the length in the X-axis direction for two layers of foam where the top layer has a lower resistance to vertical displacement than the resistance to vertical displacement of the bottom layer.

FIG. 12 depicts a vertical displacement of mattress foam material in the Z-axis direction along the length in the X-axis direction for two layers of foam where the top layer has a higher resistance to vertical displacement than the resistance to vertical displacement of the bottom layer.

DETAILED DESCRIPTION

Figure 1:
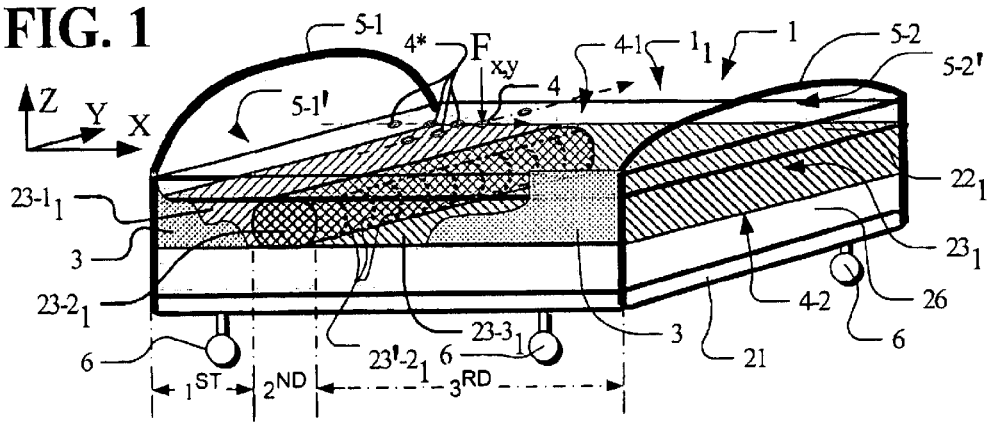
FIG. 1 depicts an isometric view of a bed having a mattress with a uniform resilient top member supported by resilient support means having variable displacement parameters.

FIG. 1 depicts an isometric view of a bed 1 having a mattress $\mathbf{1}_1$ supported by a foundation 26 and a supporting frame 21. The foundation 26 that is a box spring or other conventional mattress support. The supporting frame 21 may be any frame and typically is a conventional "Hollywood" or "Harvard" style of bed frame that is made from right-angled channels and supported by legs 6 having casters. The bed 1 and mattress $\mathbf{1}_1$ extend in the longitudinal direction (X-axis direction) from a mattress head 5-1' at bed head 5-1 to a mattress foot 5-2' at bed foot 5-2. The bed 1 and mattress $\mathbf{1}_1$ also extend in the lateral direction (Y-axis direction) normal to the X-axis.

The mattress $\mathbf{1}_1$ is for supporting a reclining person (see persons in FIG. 5 and FIG. 6) where a person's reclining body includes a head part, a shoulder part, a waist part, a hip part and a leg part. The mattress $\mathbf{1}_1$ supports a reclining body positioned in the longitudinal direction with the head part toward the mattress head 5-1' and the leg part toward the mattress foot 5-2'. A body reclining on mattress $\mathbf{1}_1$ depresses portions of the mattress causing the mattress to compress in the vertical direction (Z-axis direction) normal to the XY plane (formed by the X-axis and the Y-axis).

The mattress $\mathbf{1}_1$ is formed of a resilient top member $\mathbf{22}_1$ and resilient supporting means $\mathbf{23}_1$. The mattress $\mathbf{1}_1$ has a top surface 4-1 and a bottom surface 4-2. In the FIG. 1 embodiment, the entire top member $\mathbf{22}_1$ forms a uniform top region below the top surface 4-1 for supporting and distributing the weight of a reclining body in cooperation with resilient supporting means $\mathbf{23}_1$. The top member $\mathbf{22}_1$ is formed by one or more layers of foam having uniform displacement parameters for providing a uniform supporting surface pressure to a reclining body. The term "displacement parameters" refers to any and all the properties and characteristics of materials that determine the static and dynamic compression properties of a mattress.

The resilient supporting means $\mathbf{23}_1$, positioned below and supporting the top member $\mathbf{22}_1$, is formed of members or materials that extend in the lateral direction (Y-axis direction) and that extend in the longitudinal direction (X-axis direction) to establish different vertical displacement parameters in the longitudinal direction. The resilient supporting means $\mathbf{23}_1$ undergoes different vertical compressions in order to follow the curvature of a reclining body in the longitudinal direction and so as to establish alignment of the shoulder, waist and hip parts of the reclining body and to establish uniform low supporting surface pressure on the reclining body.

In the embodiment of FIG. 1, the resilient supporting means $\mathbf{23}_1$ is formed of three members that have different displacement parameters. The "displacement parameters" are all the properties and characteristics of materials and mattresses that determine the compression that occurs in a mattress in response to a reclining body. The three members include a first member $\mathbf{23\text{-}1}_1$, a second member $\mathbf{23\text{-}2}_1$ and a third member $\mathbf{23\text{-}3}_1$. The three members $\mathbf{23\text{-}1}_1$, $\mathbf{23\text{-}2}_1$ and $\mathbf{23\text{-}3}_1$ are resilient supporting means that function to divide the mattress $\mathbf{1}_1$ into $1^{ST}$, $2^{ND}$ and $3^{RD}$ regions. The $1^{ST}$ region is established by member $\mathbf{23\text{-}1}_1$ and is for location beneath the head and shoulder parts of a body. The $2^{ND}$ region is established by the member $\mathbf{23\text{-}2}_1$ and is for location beneath the waist part of a body. The $3^{RD}$ region is established by the member $\mathbf{23\text{-}3}_1$ and is for location beneath the hip and leg parts of a body. The three members $\mathbf{23\text{-}1}_1$, $\mathbf{23\text{-}2}_1$ and $\mathbf{23\text{-}3}_1$ have different displacement parameters that help establish the different compressions that occurs in each of the $1^{ST}$, $2^{ND}$ and $3^{RD}$ regions, respectively, in order to achieve alignment of the body with low supporting body pressure. The displacement parameters are complex and cooperate with the displacement parameters of top member $\mathbf{22}_1$.

The mattress $\mathbf{1}_1$ is covered with a non-woven quilted batting 3 which in its uncompressed condition is typically about 1½ inches thick extending above the top surface 4-1 of the mattress $\mathbf{1}_1$ and about 1/16 inch thick extending below the bottom surface 4-2 of the mattress $\mathbf{1}_1$. The batting 3 is a non-supporting member having a primary function of covering the mattress without interfering with the displacement parameters and the vertical compression that occurs with a reclining body on top of the mattress.

Figure 2:
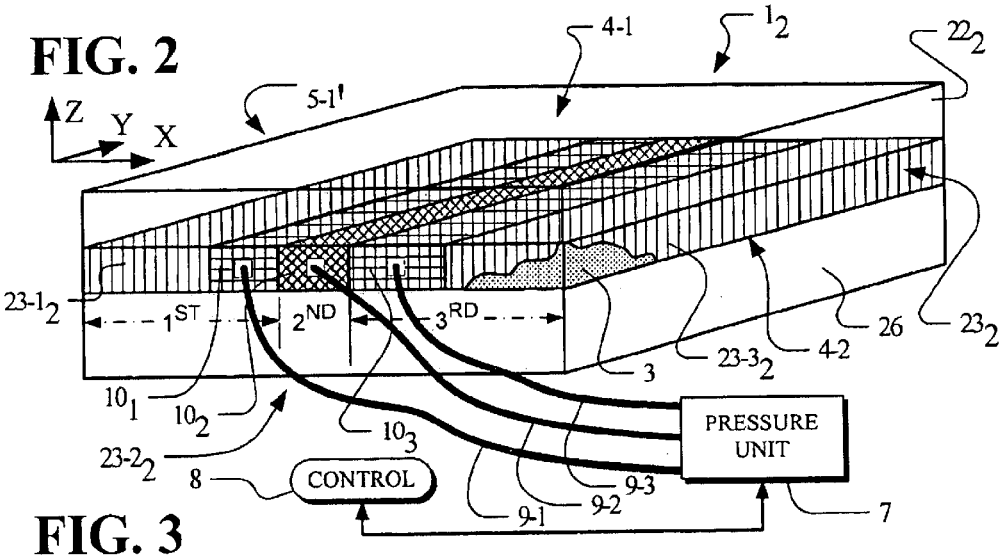
FIG. 2 depicts an isometric view of a mattress having three dynamic air-inflated adjusting members for tuning the mattress for body alignment and low contact pressure.

FIG. 2 depicts an isometric view of a mattress $\mathbf{1}_2$ formed of top member $\mathbf{22}_2$ and resilient supporting means $\mathbf{23}_2$. The resilient supporting means $\mathbf{23}_2$ includes inflatable members 10 for tuning the mattress $\mathbf{1}_2$ for body alignment and low contact pressure.

In FIG. 2, the mattress $\mathbf{1}_2$ has a top surface 4-1 and a bottom surface 4-2 and the mattress $\mathbf{1}_2$ is supported by a conventional foundation 26. In the FIG. 2 embodiment, the entire top member $\mathbf{22}_2$ constitutes a uniform top region below the top surface 4-1 for supporting and distributing the weight of a reclining body in cooperation with resilient supporting means $\mathbf{23}_2$. The top member $\mathbf{22}_2$ is formed, for example, by one or more layers of foam having uniform displacement parameters for providing a uniform supporting surface pressure to a reclining body.

The resilient supporting means $\mathbf{23}_2$, below and supporting the top member $\mathbf{22}_2$, is formed of members or materials that extend in the lateral direction (Y-axis direction) and that extend in the longitudinal direction (X-axis direction) to establish different vertical displacement parameters in the longitudinal direction of mattress $\mathbf{1}_2$. The resilient supporting means $\mathbf{23}_2$ undergoes different vertical compressions in order to follow the curvature of a reclining body in the longitudinal direction.

In the embodiment of FIG. 2, the resilient supporting means $\mathbf{23}_2$ is formed of five members. The five members have different displacement parameters and are effective in cooperating with the top member $\mathbf{22}_2$ to establish the vertical compression of the mattress $\mathbf{1}_2$ in the longitudinal direction for individual body alignment with low supporting body pressure.

In FIG. 2, the five members include a first member $\mathbf{23\text{-}1}_2$, a second member $\mathbf{23\text{-}2}_2$ and a third member $\mathbf{23\text{-}3}_2$ in the $1^{ST}$, $2^{ND}$ and $3^{RD}$ regions, respectively. The $1^{ST}$, $2^{ND}$ and $3^{RD}$ regions also include members in the form of lifts $\mathbf{10}_1$, $\mathbf{10}_2$ and $\mathbf{10}_3$, respectively, for adjusting vertical elevations in connection with compression of the mattress $\mathbf{1}_2$. The vertical lifts $10_1$, $10_2$ and $10_3$ are connected to a pressure unit 7 by the tubes 9-1, 9-2, and 9-3, respectively. The pressure unit 7 is controlled by a control device 8. In a preferred embodiment, the pressure unit 7 is an air unit including, an air pump which is turned on and off and otherwise regulated by the control 8, typically under operation of a person on the bed, for establishing different pressures and hence different vertical elevations by operation of lifts $10_1$, $10_2$ and $10_3$. In one embodiment, the lifts are constructed of airtight polyurethane inner members encased in and molded to nylon for mechanical support.

In FIG. 2, the members $23\text{-}1_2$, $23\text{-}2_2$ and $23\text{-}3_2$ together with the lifts $10_1$, $10_2$ and $10_3$ are resilient supporting means that function to divide the mattress $1_2$ in the longitudinal direction into different lateral-extending regions and sections. The $1^{ST}$ region is established by member $23\text{-}1_2$ and lift $10_1$. Member $23\text{-}1_2$ and lift $10_1$ are for location beneath head and shoulder parts of a body. The $2^{ND}$ region is established by lift $10_2$ (also identified as member $23\text{-}2_2$). The lift $10_2$ is for location beneath the waist part of a reclining body. The $3^{RD}$ region is established by lift $10_3$ and member $23\text{-}1_3$. The lift $10_3$ and member $23\text{-}1_3$ are for location beneath the hip and leg parts of a reclining body, respectively.

Figure 3:
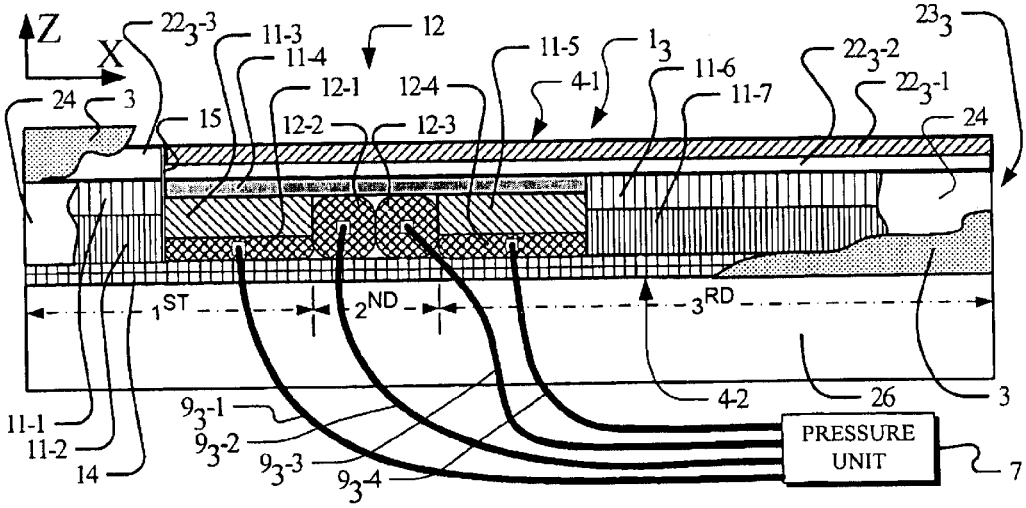
FIG. 3 depicts a side view of a mattress having four dynamic air-inflated adjusting members for tuning the mattress for body alignment and low contact pressure.

FIG. 3 depicts a side view of a mattress $1_3$ formed of a top member $22_3$ and resilient supporting means $23_3$. The resilient supporting means $23_3$ includes four lifts 12 including inflatable lifts 12-1 , 12-2, 12-3 and 12-4 for dynamically tuning the mattress $1_3$ for body alignment and low contact pressure. The lifts 12 can be inflated with air, water or any other gas or liquid suitable for a bed environment to establish different pressures and hence different vertical elevations by operation of lifts.

In FIG. 3, the mattress $1_3$ has a top surface 4-1 and a bottom surface 4-2 and the mattress $1_3$ is supported by a conventional foundation 26. In the FIG. 3 embodiment, the entire top member $22_3$ constitutes a uniform resilient top region below the top surface 4-1 for supporting and distributing the weight of a reclining body in cooperation with resilient supporting means $23_3$. The top member $22_3$ is formed, for example, by one or more layers of foam having uniform displacement parameters for providing a uniform supporting surface pressure to a reclining body.

In FIG. 3, the resilient supporting means $23_3$ is formed of multiple members that extend in the XY-plane (normal to the page) to establish different displacement parameters that help determine the mattress compression in the longitudinal direction for alignment of the head, shoulder, waist, hip and leg parts of a reclining body at low supporting body surface pressure.

The top member $22_3$ and the resilient supporting means $23_3$ have a lateral slot 15 that extends through top member $22_3$ from the top surface 4-1 to and partially through the resilient supporting means $23_3$ to a bottom member 14. The slot 15 extends laterally across (in a direction normal to the page in FIG. 3) the mattress $1_3$. The slot 15 functions to relieve tension forces that would otherwise be created by shoulder depression into the mattress $1_3$.

In the embodiment of FIG. 3, the multiple members forming resilient supporting means $22_3$ include lifts 12-1, 12-2, 12-3 and 12-4, foam members 11-1, 11-2, . . . , 11-7 and a bottom member 14. The lifts 12-1, 12-2, 12-3 and 12-4 are connected to a pressure unit 7 by the tubes $9_3\text{-}1$, $9_3\text{-}2$, $9_3\text{-}3$ and $9_3\text{-}4$, respectively. The pressure unit 7 is controlled by a control device 8 (see FIG. 2). In a preferred embodiment, the pressure unit 7 is an air control device including an air pump which is turned on and off and otherwise regulated by the control device 8 for establishing different pressures in and hence different elevations established by the lifts 12-1, 12-2, 12-3 and 12-4.

The foam members 11-1 and 11-2 are a section of the mattress in the $1^{ST}$ region and are positioned toward the head 5-1' of the mattress $1_3$ and are for supporting the head part of a reclining body. The foam members 11-1 and 11-2 are beneath the top member $22_3\text{-}3$. Together the top member $22_3$ and the foam members 11-1 and 11-2 provide appropriate displacement parameters for the head part of a reclining body.

The lift 12-1 and foam member 11-3 are a section of the mattress located beneath an integrating foam member 11-4 and are in turn beneath the top member $22_3$. The lift 12-1 is for adjusting the vertical elevations of mattress $1_3$ in the shoulder region, a part of the $1^{ST}$ region. Together the top member $22_3$, lift 12-1 and foam member 11-3 provide appropriate displacement parameters for the shoulder part of a reclining body. The lifts 12-2 and 12-3 are in a section of the mattress located beneath the foam member 11-4 and are in turn beneath the top member $22_3$. The lifts 12-2 and 12-3 are for adjusting the vertical elevations of mattress $1_3$ in the waist region, the $2^{ND}$ region. Together the top member $22_3$ lifts 12-2 and 12-3 and foam member 11-4 provide appropriate displacement parameters for the waist part of a reclining body.

The lift 12-4 and foam member 11-5 are in a section of the mattress located beneath the integrating foam member foam member 11-4 and are in turn beneath the top member $22_3$. The lift 12-4 is for adjusting the vertical elevations of mattress $1_3$ in the hip region, a part of the $3^{RD}$ region. Together the top member $22_3$, lift 12-4, foam member 11-5 and foam member 11-4 provide appropriate displacement parameters for the hip part of a reclining body.

The foam members 11-6 and 11-7 are in a section of the mattress located beneath the top member $22_3$ and provide appropriate displacement parameters for the leg part of a reclining body.

The mattress $1_3$ includes a bottom foam member 14 which extends from the head of the mattress 5-1' to the foot of the mattress 5-2'. The bottom foam member 14 functions to provide a firm base for all the components of the resilient supporting means $23_3$. Additionally, surrounding a portion of the perimeter of the mattress $1_3$, preferable excluding the head of the mattress, is a firm foam member 24 which is shown partially broken away in FIG. 3. The foam member 24 functions to provide a firm outer edge for the mattress $1_3$. The firm foam member 24 renders the mattress comfortable for a person sitting on the edge of the bed. The mattress $1_3$ has a covering 3 including covered with a non-woven quilted batting enclosed in a covering fabric which in its uncompressed condition is about 1½ inches thick extending above the top surface 4-1 of the mattress $1_3$ and about 1/16 inch thick on the sides and at the bottom surface 4-2 of the mattress $1_3$. The covering 3 is a non-supporting layer having a primary function of covering and containing the supporting layers, including the top member $22_3$ and resilient supporting means $23_3$ without interfering with the displacement parameters and the compression that occurs with a reclining body on top of the mattress. The covering fabric 3 functions to contain the resilient top member $22_3$ and resilient supporting means $23_3$ and each of the internal members of the mattress $1_3$.

One embodiment of the mattress of FIG. 3 has the displacement parameters established using the following materials shown in TABLE 1.

TABLE 1

| Member | 11-1 | 11-2 | 11-3 | 11-4 | 11-5 | 11-6 | 11-7 | 14 | $22_3$-1 | $22_3$-2 | 24 |
|---|---|---|---|---|---|---|---|---|---|---|---|
| IFD | 28R | 28R | 15R | 15R | 15R | 15R | 28HR | 55HR | 15R | 13VE | 55HR |
| Thickness | 3 in | 4 in | 5 in | 2 in | 5 in | 3 in | 4 in | 1 in | 2.5 in | 1.5 in | 7 in |

The materials of TABLE 1 are available under the Resilitex™ polyurethane product line for mattress materials of Foamex International Inc. but any polyurethane or other foam material having similar displacement parameters can be used.

In FIG. 3 and TABLE 1, the resilient top member $\mathbf{22_3}$ is formed by a composite of member $\mathbf{22_3}$-1, member $\mathbf{22_3}$-2 and member $\mathbf{22_3}$-3. Member $\mathbf{22_3}$-1 is 2.5 inches thick and member $\mathbf{22_3}$-2 is 1.5 inches thick with member $\mathbf{22_3}$-1 is on top of member $\mathbf{22_3}$-2. The members $\mathbf{22_3}$-1 and $\mathbf{22_3}$-2 are separated from the member $\mathbf{22_3}$-3 by the lateral slot 15 to permit free depression by the shoulder of a body. With the dimensions of TABLE 1, the mattress $\mathbf{1_3}$ is 12 inches thick without accounting for the thickness of the covering 3 which is approximately 1.5 to 2 inches so that the overall mattress $\mathbf{1_3}$ is approximately 14 inches thick and in standard widths and lengths. In general, the different foam members are adhered together with adhesive or other binding means to increase the stability of the mattress.

In another embodiment, the mattress of FIG. 3 has the displacement parameters established using the materials identified in the following TABLE 2.

TABLE 2

| Member | 11-1 | 11-2 | 11-3 | 11-4 | 11-5 | 11-6 | 11-7 | 14 | $22_3$-1 | $22_3$-2 | 22hd 3-3 | 24 |
|---|---|---|---|---|---|---|---|---|---|---|---|---|
| IFD | 28R | 28R | 15R | 24R | 15R | 15R | 28R | 55HR | 15R | 13VE | 6R | 55HR |
| Thickness | 4 in | 4 in | 4 in | 2 in | 4 in | 4 in | 4 in | 1 in | 2 in | 2 in | 2 in | 8 in |

Note in TABLE 2 that the top member $\mathbf{22_3}$ is formed by a composite of two members $\mathbf{22_3}$-1 and $\mathbf{22_3}$-2 and a head piece member $\mathbf{22_3}$-3, where member $\mathbf{22_3}$-1 is 2 inches thick, member $\mathbf{22_3}$ is 2 inches thick and member $\mathbf{22_3}$-3 is 4 inches thick where member $\mathbf{22_3}$-1 is on top of member $\mathbf{22_3}$-2. The members $\mathbf{22_3}$-1 and $\mathbf{22_3}$-2 are separated from the member $\mathbf{22_3}$-3 by the lateral slot 15 to permit free depression by the shoulder of a body. With the dimensions of TABLE 2, the mattress $\mathbf{1_3}$ is 13 inches thick without accounting for the thickness of the covering 3 which is approximately 1.5 to 2 inches so that the overall mattress $\mathbf{1_3}$ is approximately 15 inches thick and in standard widths and lengths.

Figure 4:
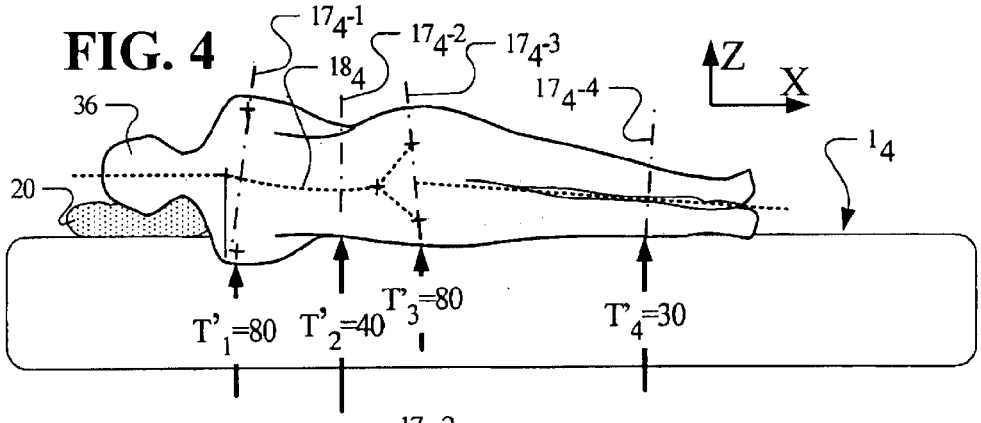
FIG. 4 depicts a side view of a mattress causing body misalignment.

FIG. 4 depicts a side view of a mattress $\mathbf{1_4}$ that has not been tuned for body alignment and hence functions the same as a conventional mattress with regard to body alignment. A pillow 20 is below the head of a reclining side-lying female body 36. The shoulders have an alignment line $\mathbf{17_4}$-1, the waist has an alignment line $\mathbf{17_4}$-2, the hips have an alignment line $\mathbf{17_4}$-3, the legs have an alignment line $\mathbf{17_4}$-4 and the spine has an alignment line $\mathbf{18_4}$. In FIG. 4, the waist of the body has sagged so the spine as indicated by spine alignment line $\mathbf{18_4}$ sags and is not straight. Further, when mattress $\mathbf{1_4}$ is a conventional mattress, the surface pressures $T'_1$, $T'_2$, $T'_3$and $T'_4$ at the shoulder alignment line $\mathbf{17_4}$-1, the waist alignment line $\mathbf{17_4}$-2, the hip alignment line $\mathbf{17_4}$-3 and the leg alignment line $\mathbf{17_4}$-4 are typically 80, 40, 80 and 30 mmHg, respectively. The 80 and 40 values are above the ischemic pressure and hence tend to cause bed-induced shifting in a conventional mattress.

Figure 5:
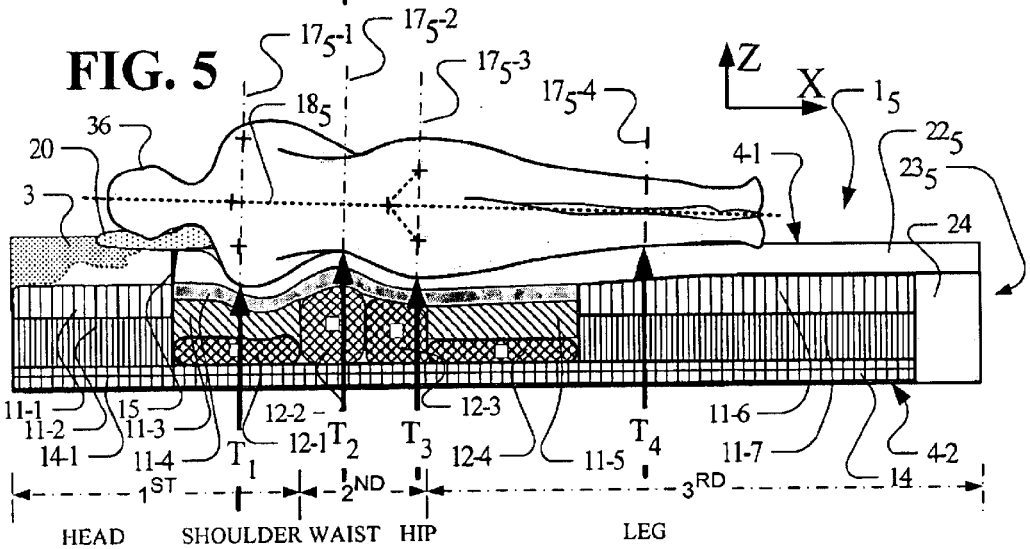
FIG. 5 depicts a side view of the mattress of FIG. 3 tuned for a Caucasian female of a 2.5 percentile body dimensions reclining on her side.

FIG. 5 depicts a side view of the mattress of FIG. 3 tuned for a Caucasian female body 36, having 2.5 percentile body dimensions, reclining on her side.

In FIG. 5, the top member $\mathbf{22_5}$ has a top surface 4-1 that has been depressed by the body 36 so that it follows the curvature of the body. The top member $\mathbf{22_5}$ is in contact with the body and functions to support and distribute the weight of the body in cooperation with resilient supporting means $\mathbf{23_5}$. The top member $\mathbf{22_5}$ is formed, for example, by one layer of constant thickness foam having uniform displacement parameters for providing a uniform supporting surface pressure to the reclining body 36. A pillow 20 is positioned under the head of body 36.

In the $1^{ST}$ region, the head section includes the foam members 11-1 and 11-2 for supporting the head part of reclining body 36. The foam members 11-1 and 11-2 undergo only a small compression and provide appropriate displacement parameters for the head part of the side-lying female body 36. The shoulder section includes the foam member 11-3, foam member 11-4 and lift 12-1. The foam member 11-3, an integrating foam member 11-4 and top member $\mathbf{22_5}$, have substantial compression in response to the shoulder of the reclining body 36. The lift 12-1 is for adjusting the vertical elevation of mattress $\mathbf{1_5}$ in the shoulder region, if necessary, but in FIG. 5 the vertical elevation imparted by lift 12-1 is about the same as in FIG. 3. Together the foam member 11-3, foam member 11-4 and top member $\mathbf{22_5}$ and lift 12-1 provide appropriate displacement parameters for the shoulder part of the side-lying female body 36.

In the $2^{ND}$ region, the waist section includes the lifts 12-2 and 12-3 and the foam member 11-4 for supporting the waist part of reclining body 36. The lifts 12-2 and 12-3 are adjusted so that the vertical elevation imparted to the mattress $\mathbf{1_5}$ is higher for lift 12-2, which is under the waist region of the reclining body 36, than the vertical elevation imparted by lift 12-3 which is closer to the hip part of the reclining body 36. Together the top member $\mathbf{22_5}$, lifts 12-2 and 12-3 and foam member 11-4 provide appropriate displacement parameters for the waist part of the side-lying female body 36.

the $3^{RD}$ region, the hip section including the lift 12-4, foam member 11-5 and foam member 11-4, the foam members have compression in response to the hip of the reclining body 36. The lift 12-4 adjusts the vertical elevations of mattress $\mathbf{1_5}$ in the hip region but in FIG. 6 the vertical elevation imparted by lift 12-4 is about the same as in FIG. 3. Together the top member $\mathbf{22_5}$, lift 12-4, foam member 11-5 and foam member 11-4 provide appropriate displacement parameters for the hip part of the side-lying female body 36. In the leg section, the foam members 11-6 and 11-7 have slight compression in response to the leg of the reclining body 36. The foam members 11-6 and 11-7 together with the top member $\mathbf{22}_5$ provide appropriate displacement parameters for the leg part of the side-lying female body 36.

In FIG. 5, the shoulders have an alignment line $\mathbf{17}_5$-1, the waist has an alignment line $\mathbf{17}_5$-2, the hips have an alignment line $\mathbf{17}_5$-3, the legs have an alignment line $\mathbf{17}_{25}$-4 and the spine has an alignment line $\mathbf{18}_5$. In FIG. 5, the waist of the body is straight so the spine alignment line $\mathbf{18}_5$ is straight. The surface pressures $T_1$, $T_2$, $T_3$ and $T_4$ at the shoulder alignment line $\mathbf{17}_5$-1, the waist alignment line $\mathbf{17}_5$-2, the hip alignment line $\mathbf{17}_5$-3 and the leg alignment line $\mathbf{17}_5$-4 are typically low and below a low pressure threshold. For a tuned bed made of properly selected foams and other materials, the low pressure threshold is below the ischemic pressure of about 30 mmHg.

The pressure as measured at any point on the interface between the body 36 and the mattress $\mathbf{1}_5$ is established as a combination of the supporting forces applied by the mattress members under the supporting point. For example, the supporting forces under the $T_1$ interface point at the shoulder part of body 36 combines the supporting forces of base layer 14, lift 12-1, foam member 11-3, foam member 11-4 and foam member $\mathbf{22}_5$. Each of these members has a different resistance to compression and, in general, that resistance is non-linear as a function of the amount of compression. The displacement parameters for foam materials include an ILD (indentation load deflection) value that indicates the resistance to compression of the material. Generally, lifts or other members are employed in combination with resilient foam members to adjust the elevation below a foam member so that the range of elevation over which a foam member is compressed is within a satisfactory operating range. When a vertical stack of resilient foam members is employed, then each of the foam members in the stack operates over its own satisfactory operating range. A satisfactory operating range for foam in a mattress is generally at less than about 50 percent compression. As compression exceeds about 50 percent, the ILD value increases significantly until the foam member acts more as a taught membrane than as resilient foam. A foam member stretched to approach the membrane threshold imparts high pressure to a reclining body and is to be avoided.

To achieve uniform low pressure on a reclining body, the accumulated displacement parameters, DP(x), for the mattress members under each small segment x along the X-axis of the interface between the body and the mattress must establish the desired low pressure for the supporting pressure applied to the body. Supporting forces are supplied from the bottom of the mattress to the top of the mattress where each lower member transmits the supporting forces to a higher member in a vertical stack of members as a function of the displacement parameters of the members in the stack. The members have different displacement parameters, DP, that are combined so that supporting force, $SF_Z$, along the X-axis is applied locally at any coordinate, x, as a force, F(x). The local force, F(x) is applied against the combined local displacement parameters, DP(x) whereby $SF_z=F(x)\bullet DP(x)$.

Figure 6:
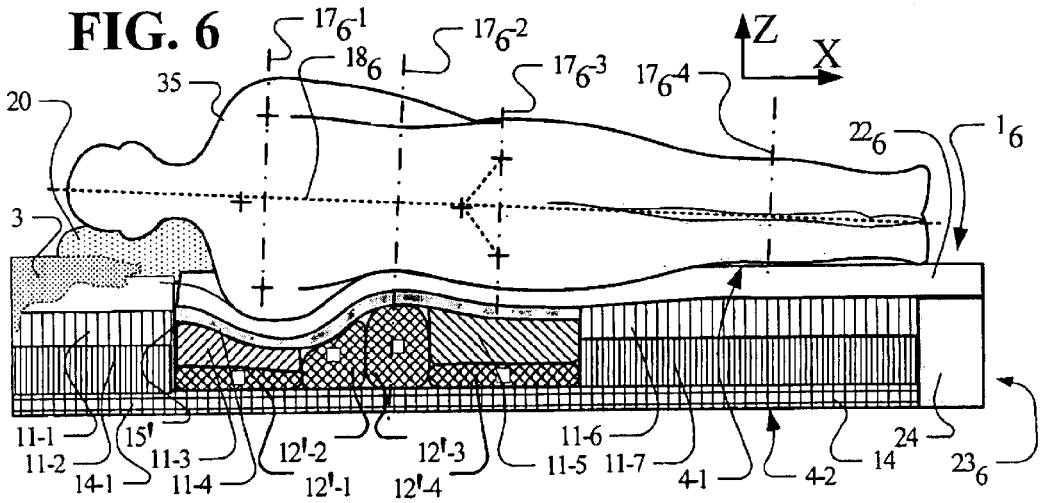
FIG. 6 depicts a side view of the mattress of FIG. 3 tuned for a Caucasian male of a 97.5 percentile body dimensions reclining on his side.

FIG. 6 depicts a side view of the mattress of FIG. 3 tuned for a Caucasian male body 35, having 97.5 percentile body dimensions, reclining on his side.

In FIG. 6, the top member $\mathbf{22}_6$ has a top surface 4-1 that has been depressed by the body 35 so that it follows the curvature of the body. The top member $\mathbf{22}_6$ is in contact with the body and functions to support and distribute the weight of the body in cooperation with resilient supporting means $\mathbf{23}_6$. The top member $\mathbf{22}_6$ is formed, for example, by one layer of constant thickness foam having uniform displacement parameters for providing a uniform supporting surface pressure to the reclining body 35. A pillow 20 is positioned under the head of body 35.

In the $1^{ST}$ region, the head section includes the foam members 11-1 and 11-2 for supporting the head part of reclining body 35. The foam members 11-1 and 11-2 undergo only a small compression and provide appropriate displacement parameters for the head part of the side-lying male body 35. The shoulder section includes the foam member 11-3, foam member 11-4 and lift 12'-1. The foam member 11-3, foam member 11-4 and top member $\mathbf{22}_5$ have substantial compression in response to the shoulder of the reclining body 35. The lift 12'-1 is for adjusting the vertical elevation of mattress $\mathbf{1}_6$ in the shoulder region, if necessary, but in FIG. 5 the vertical elevation imparted by lift 12'-1 is about the same as in FIG. 3. Together the foam member 11-3, foam member 11-4 and top member $\mathbf{22}_5$ and lift 12'-1 provide appropriate displacement parameters for the shoulder part of the side-lying male body 35.

In the $2^{ND}$ region, the waist section includes the lifts 12'-2 and 12'-3 and the foam member 11-4 for supporting the waist part of reclining body 35. The lifts 12'-2 and 12'-3 are adjusted so that the vertical elevation imparted to the mattress $\mathbf{1}_6$ is higher for lift 12'-3, which is under the waist region of the reclining body 35, than the vertical elevation imparted by lift 12'-2 which is closer to the shoulder part of the reclining body 35. Together the top member $\mathbf{22}_6$, lifts 12'-2 and 12'-3 and foam member 11-4 provide appropriate displacement parameters for the waist part of the side-lying male body 35.

In the $3^{RD}$ region, the hip section including the lift 12'-4, foam member 11-5 and foam member 11-4, the foam members have compression in response to the hip of the reclining body 35. The lift 12'-4 adjusts the vertical elevations of mattress $\mathbf{1}_6$ in the hip region but in FIG. 6 the vertical elevation imparted by lift 12'-4 is about the same as in FIG. 3. Together the top member $\mathbf{22}_6$, lift 12'-4, foam member 11-5 and foam member 11-4 provide appropriate displacement parameters for the hip part of the side-lying male body 35. In the leg section, the foam members 11-6 and 11-7 have slight compression in response to the leg of the reclining body 35. The foam members 11-6 and 11-7 together with the top member $\mathbf{22}_6$ provide appropriate displacement parameters for the leg part of the side-lying male body 35.

In FIG. 6, the shoulders have an alignment line $\mathbf{17}_6$-1, the waist has an alignment line $\mathbf{17}_6$-2, the hips have an alignment line $\mathbf{17}_6$-3, the legs have an alignment line $\mathbf{17\text{-}4}_6$ and the spine has an alignment line $\mathbf{18}_6$. In FIG. 6, the waist of the body is straight so the spine alignment line $\mathbf{18}_6$ is straight. The surface pressures $T_1$, $T_2$, $T_3$ and $T_4$ at the shoulder alignment line $\mathbf{17}_6$-1, the waist alignment line $\mathbf{17}_6$-2, the hip alignment line $\mathbf{17}_6$-3 and the leg alignment line $T_6$ are typically low and below a low pressure threshold. For a tuned bed made of properly selected foams and other materials, the low pressure threshold is below the ischemic pressure of about 30 mmHg.

FIG. 7 depicts a vertical displacement, $E_Z$, in the Z-axis direction along the length in the X-axis direction of the side-lying female of FIG. 5. The vertical displacements are shown for the neck as E7, for the shoulder at E12, for the waist at E20, for the hips at E19 and for the legs at E44. The numbers represent approximately the number of inches from the head where the vertical displacements are measured. The sharpest change in vertical displacement over a distance along the X-axis is between the neck vertical displacement E7 and shoulder vertical displacement E12. In general, the vertical displacement pattern, $E_Z$, is a function of the X-axis position, x, that is, $E_Z=f(x)$ where f(x) is the curve in FIG. 7 for one particular body 36 in FIG. 5.

FIG. 8 depicts a vertical displacement in the Z-axis direction along the length in the X-axis direction of the side-lying male of FIG. 6. The vertical displacements are shown for the neck as E11, for the shoulder at E19, for the waist at E29, for the hips at E41 and for the legs at E62. The numbers represent the number of inches from the head where the vertical displacements are measured. The sharpest change in vertical displacement over a distance along the X-axis is between the neck vertical displacement E11 and shoulder vertical displacement E19. In general, the vertical displacement, $E'_Z$, is a function of the X-axis position, x, that is, $E'_Z=f'(x)$ where f'(x) is the curve in FIG. 8 for one particular body 35 in FIG. 6.

When the top of the heads for the female in FIG. 5 and the male in FIG. 6 are in alignment, FIG. 7 and FIG. 8 show that the vertical waist measurement is a high value for the female (E20) while at about the same X-axis distance, the vertical shoulder measurement for the male is low (E19). Also, the maximum vertical displacement for the female ($D_f$) is less than half the maximum vertical displacement for the male ($D_m$). These differences between the small-body displacements represented by the female body of FIG. 5 and the large-body displacements represented by the male body of FIG. 6 must be accounted for in the mattress structure in order to achieve mattresses that provide body alignment and low body supporting pressure.

FIG. 9 depicts a vertical displacement caused by a force depressing local area 4 of the mattress of FIG. 1. Typically the mattress material of area 4 is a foam such as polyurethane. Polyurethane and other foams are commercially available for a wide variety of applications including mattresses. The displacement parameters of foams are complex. Foams have varying density, varying ILD (indentation load deflection) sometimes called IFD (indentation force deflection) and many other parameters. Foams in general exhibit excellent shape retention and high resistance to wear. Foams are available in different pore sizes ranging from 3 pores per linear inch (coarse and abrasive) to 110 pores per linear inch (soft and downy). An example of some displacement parameters for two commercially available foams are given in the following TABLE 3.

TABLE 3

| PARAMETER | FOAM 1 | FOAM2 |
|---|---|---|
| Density (pcf) | 3 | 3 |
| IFD 25% | 15 | 32 |
| IFD 65% | 34 | 70 |
| SAG | 2.3 | 2.2 |
| Elevation Retention % | 99 | 99 |
| IFD Retention % | 95.3 | 94.7 |
| Tensile % | 10.8 | 16.9 |
| Elongation % | 163 | 156 |
| Tear (pli) | 1 | 1.2 |
| Ball Rebound | 72 | 70 |
| Compression Set 75% | <5 | <5 |
| Compression Set 90% | <5 | <5 |

In FIG. 9, an external depression force $F_{x0,y0}$ is applied vertically (Z-axis direction) normal to surface of the foam lying parallel to the XY-plane (formed by the X-axis and the Y-axis). The depression force $F_{x0,y0}$ is applied to a foam at some location [x0,y0] and causes a compression of the foam that is measured as a vertical displacement $D_{x0,y0}$ at location [x0,y0]. The magnitude of the displacement $D_{x0,y0}$ in response to the external depression force $F_{x0,y0}$ is determined by the displacement parameters of the foam. When the external depression force $F_{x0,y0}$ is applied to the foam, the displacement increases until the mattress resistance force $R_{x0,y0}$ exerted by the foam as a result of compression equals the external depression force $F_{x0,y0}$. A condition of equilibrium results when the external depression force $F_{x0,y0}$ equals the foam resistance force $R_{x0,y0}$. The displacement $D_{x0,y0}$ is the displacement that results at that condition of equilibrium.

In a foam material, foam at adjacent locations near the applied force location [x0,y0] are also compressed because of the lateral tensile transfer characteristic of foams. Referring to FIG. 9, locations [x1,y1]; [x1,y2]; [x3,y3] and [x4,y4] are represented by circle 4' where circle 4' is at some radius from location [x0,y0]. The displacements at those locations are D[x1,y1]; D[x1,y2]; D[x3,y3] and D[x4,y4], respectively, and those displacements at 4' are less than displacement D[x0,y0] at location [x0,y0]. At still additional locations represented by circle 4 in FIG. 9, where circle 4 is at some greater radius from location [x0,y0] than circle 4', the displacements resulting from the external depression force $F_{x0,y0}$ are negligible.

In FIG. 9, the external depression force $F_{x0,y0}$ is representative of many similar forces imparted to a mattress by a reclining body. In order to determine the actual depressions resulting from a reclining body, the depression forces must be integrated over all the parts of the body in contact with the mattress. Such an integration is mathematically difficult since as can be noted from TABLE 3 above, the forces due to compression of mattress materials are not linear. For example, the ILD for a foam material is different at 25% compression than it is at 65% compression.

FIG. 10 depicts a vertical displacement of foam material in response to an external depression force $F_{x,y}$ applied in the Z-axis direction. The displacement is observed along the X-axis for a first foam member 133 positioned over a second foam member 134 where the two foam members are the same thickness and have the same resistance to vertical displacement (that is, the same ILD value). In FIG. 10, an external depression force $F_{x,y}$ is applied vertically to the surface of the foam member 133 and causes a compression of the foam member 133 resulting in a vertical displacement $D_1$. The magnitude of the displacement $D_1$ is determined by the displacement parameters of the foam member 133. The depression force $F_{x,y}$ is transferred through the foam member 133 to foam member 134. The depression force $F_{x,y}$ causes a compression of the foam member 134 resulting in a vertical displacement $D_2$ in of the foam member 134. The magnitude of the displacement $D_2$ is about the same as the magnitude of vertical displacement $D_1$. FIG. 10 demonstrates that when two foam members having the same displacement parameters are stacked, the compression results are about the same as for a single foam member of twice the thickness.

FIG. 11 depicts a vertical displacement of foam material in response to an external depression force $F_{x,y}$ applied in the Z-axis direction. The displacement is observed along the X-axis for a first foam member 135 positioned over a second foam member 136. The first foam member 135 is thicker than and has a lower resistance to vertical displacement (that is, lower ILD value) than the second foam member 136. In FIG. 11, an external depression force $F_{x,y}$ is applied vertically to the surface of the foam member 135 and causes a compression of the foam member 135 resulting in a vertical displacement $D_3$. The magnitude of the displacement $D_3$ is determined by the displacement parameters of the foam member 135. The depression force $F_{x,y}$ is transferred through the foam member 135 to foam member 136. The depression force $F_{x,y}$ causes a compression of the foam member 136 resulting in a vertical displacement $D_4$ in of the foam member 136. The magnitude of the displacement $D_3$ is much greater than the magnitude of the displacement $D_4$. FIG. 11 demonstrates the characteristic that when two foam members of different ILD value, thickness and other displacement parameters are stacked vertically to respond to an external force such as a reclined body, the results are a complex interaction of the different materials. Note that most of the vertical displacement occurred in a local area of the thicker, lower ILD value foam member 135.

FIG. 12 the vertical displacement of foam material in response to an external depression force $F_{x,y}$ applied in the Z-axis direction to a first foam member 137. The first foam member 137 is positioned over a second foam member 138 where the foam member 137 is about the same thickness as the foam member 138 and the foam member 137 has a higher ILD value than the foam member 138. In FIG. 12, two external depression forces $F_{x1,y}$ and $F_{x2,y}$ representing a body part such as a shoulder are applied vertically to the foam member 137. The external depression forces $F_{x1,y}$ and $F_{x2,y}$ cause a compression of the foam member 137 by a vertical displacement that tends to be local in a width L1 and tends to wrap around the depression forces $F_{x1,y}$ and $F_{x2,y}$ The magnitude of the displacement width $L_1$ is determined by the ILD value and other displacement parameters of the foam member 137. The depression forces $F_{x1,y}$ and $F_{x2,y}$ are transferred through the foam member 137 to foam member 138. The depression forces $F_{x1,y}$ and $F_{x2,y}$ cause a compression of the foam member 138 with a small vertical displacement that tends to be distributed over a displacement width L2 that is large relative to L1. FIG. 12 demonstrates the characteristic that when two foam members of different ILD value and other displacement parameters are stacked vertically to respond to an external force such as a reclined body part, the resulting compression is a complex interaction of the different materials. Note that in FIG. 12 most of the vertical compression occurred in a local area of the top higher ILD value foam member 137. The compression, D5, of the lower ILD value foam member 138 in FIG. 12 is greater than the compression of the higher ILD value member 136 in FIG. 11.

Figure 13:
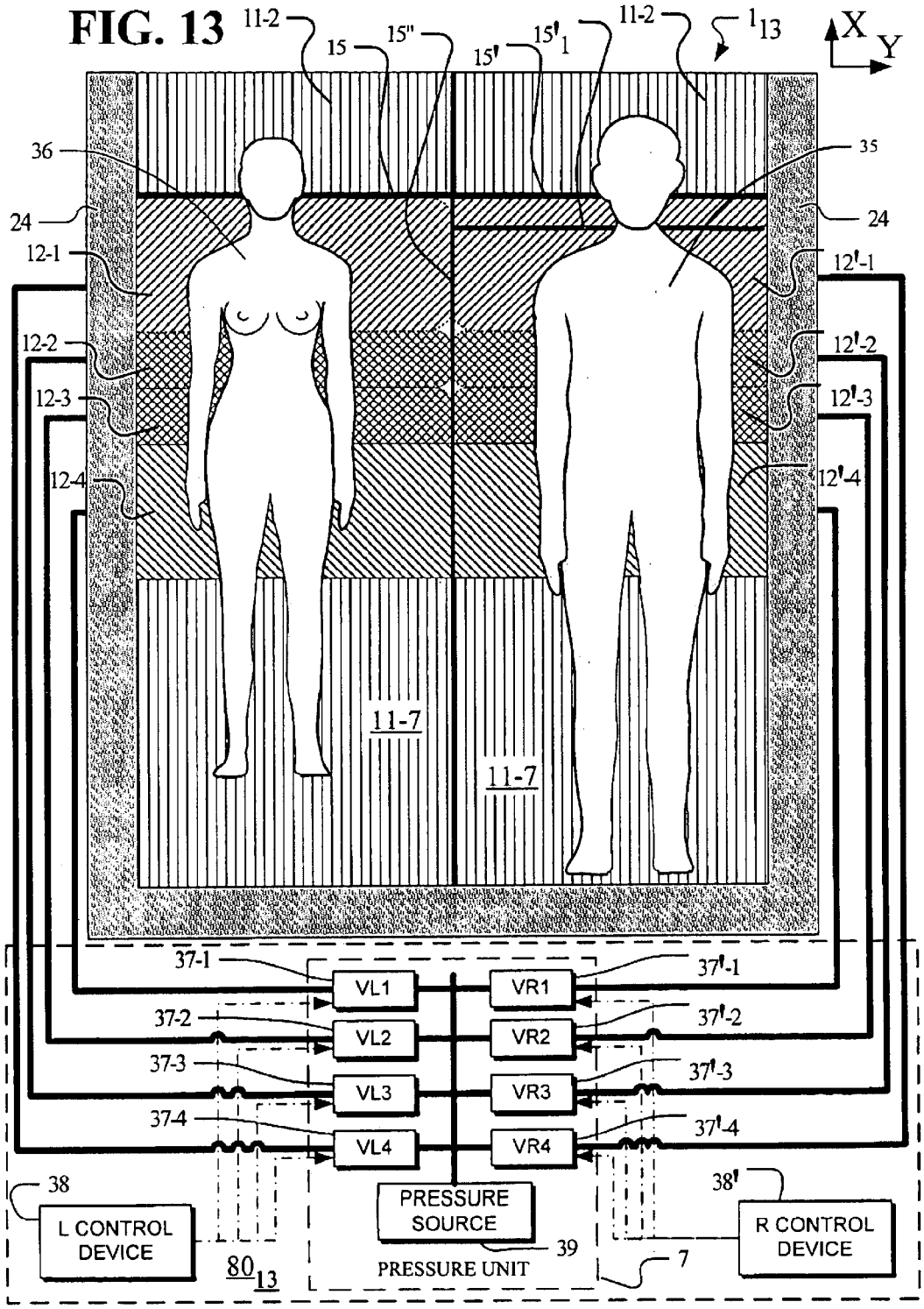
FIG. 13 depicts a top view of one embodiment of the mattress of FIG. 3 with a Caucasian female of 2.5 percentile body dimensions reclining on her back on the left and a Caucasian male of 97.5 percentile body dimensions reclining on his back on the right together with a pressure unit and a left control device and a right control device.

FIG. 13 depicts a top view of one embodiment of the mattress of FIG. 3 with a Caucasian female, with 2.5 percentile body dimensions, on her back on the left and a Caucasian male, with 97.5 percentile body dimensions, on his back on the right. In FIG. 13, the upper layers of foam for the mattress of FIG. 3 have been stripped away to show the lifts 12 and 12' and the head and leg foam members 11-2 and 11-7, respectively. The lifts 12 and 12' are separated from the foam members 11-2 by lateral slots 15 and 15', respectively. Also, a longitudinal slot 15" extends between the left and right sides of mattress $\mathbf{1}_{13}$. In FIG. 13, the lateral slots 15 and 15' are collinear, but the slots in other embodiments are offset from each other. Also, in other embodiments, plural slots like slots 15 and 15' are employed. For example, in FIG. 13, a second slot $\mathbf{15'}_1$ is located offset from slot 15' by 2 to 3 inches. When plural slots are employed, the depth of the slots in the Z-axis direction can vary. For example and referring to FIG. 3, slot $\mathbf{15'}_1$ only extends through member $\mathbf{22}_3$, member 11-4 and member 11-3. To help insure that such slots do not roll over or otherwise distort, the vertical side walls of the slots are made of or are coated with a slippery material such as Tyvek® or other material that slides easily and with low friction. The foam material 24 extends on a substantial portion of the perimeter of the mattress $\mathbf{1}_{13}$ around the left and right sides and along the foot of mattress $\mathbf{1}_{13}$.

In FIG. 13 and in FIG. 3, the left and right sides of the mattresses are generally symmetrical, but in other embodiments the left and right sides are asymmetrical with the size of the different members in the longitudinal direction varying.

In FIG. 13, the control unit $\mathbf{80}_{13}$ is a control means for adjusting the vertical elevations of mattress $\mathbf{1}_{13}$ and includes pressure unit 7 and left and right control devices 38 and 38', respectively. The female body 36 has access to the left control device 38 for controlling the pressure unit 7 to inflate or deflate the lifts 12. The lift 12-1 is under the shoulder region, the lifts 12-2 and 12-3 are under the waist region with lift 12-3 toward the hip region and the lift 12-4 is under the hip region. The shoulder lift 12-1 is controlled by the air valve 37-1, the waist lift 12-2 is controlled by the air valve 37-2, the waist-hip lift 12-3 is controlled by the valve 37-3 and the hip lift 12-4 is controlled by the hip valve 37-4.

In operation, person 36 actuates the left control device 38 to adjust any one of the lifts 12-1, 12-2, 12-3 and 12-4. For example, to increase the pressure in the waist lift 12-2 and hence the elevation in the waist region, the person 36 actuates valve unit 37-2 using left control 38. Upon actuation, the pressure source 39 in the pressure unit 7 causes air to pass through the actuated valve 37-2 to increase the pressure in the lift 12-2. If the pressure in lift 12-2 is to be decreased, the right control device 38 is actuated, to control valve 7-2, to vent some of the air in lift 12-2 into the atmosphere. In a similar manner, each of the other lifts 12 can be increased or decreased in pressure so that the vertical alignment of all of the lifts is under control of the person 36.

The male body 35 has access to the right control device 38' for controlling the pressure unit 7 to inflate or deflate the lifts 12'. The lift 12'-1 is under the shoulder region, the lifts 12'-2 and 12'-3 are under the waist region with lift 12'-2 toward the shoulder region and the lift 12'-4 is under the hip region. The shoulder lift 12'-1 is controlled by the air valve 37-1, the waist lift 12'-2 is controlled by the air valve 37-2, the waist-hip lift 12'-3 is controlled by the valve 37-3 and the hip lift 12'-4 is controlled by the hip valve 37-4.

In operation, person 35 actuates the right control device 38' to adjust any one of the lifts 12'-1, 12'-2, 12'-3 and 12'-4. For example, to increase the pressure in the waist lift 12'-2 and hence the elevation in the waist region, the person 35 actuates valve unit 38' using left control 38'. Upon actuation, the pressure source 39 in the pressure unit 7 causes air to pass through the valve 37-3 to increase the pressure in the lift 12'-3. If the pressure in lift 12'-3 is to be decreased, the right control device 38' is actuated, to control valve 7-3, to vent some of the air in lift 12'-3 into the atmosphere. In a similar manner, each of the other lifts 12' can be increased or decreased in pressure so that the vertical alignment of all of the lifts is under control of the person 35.

Figure 14:
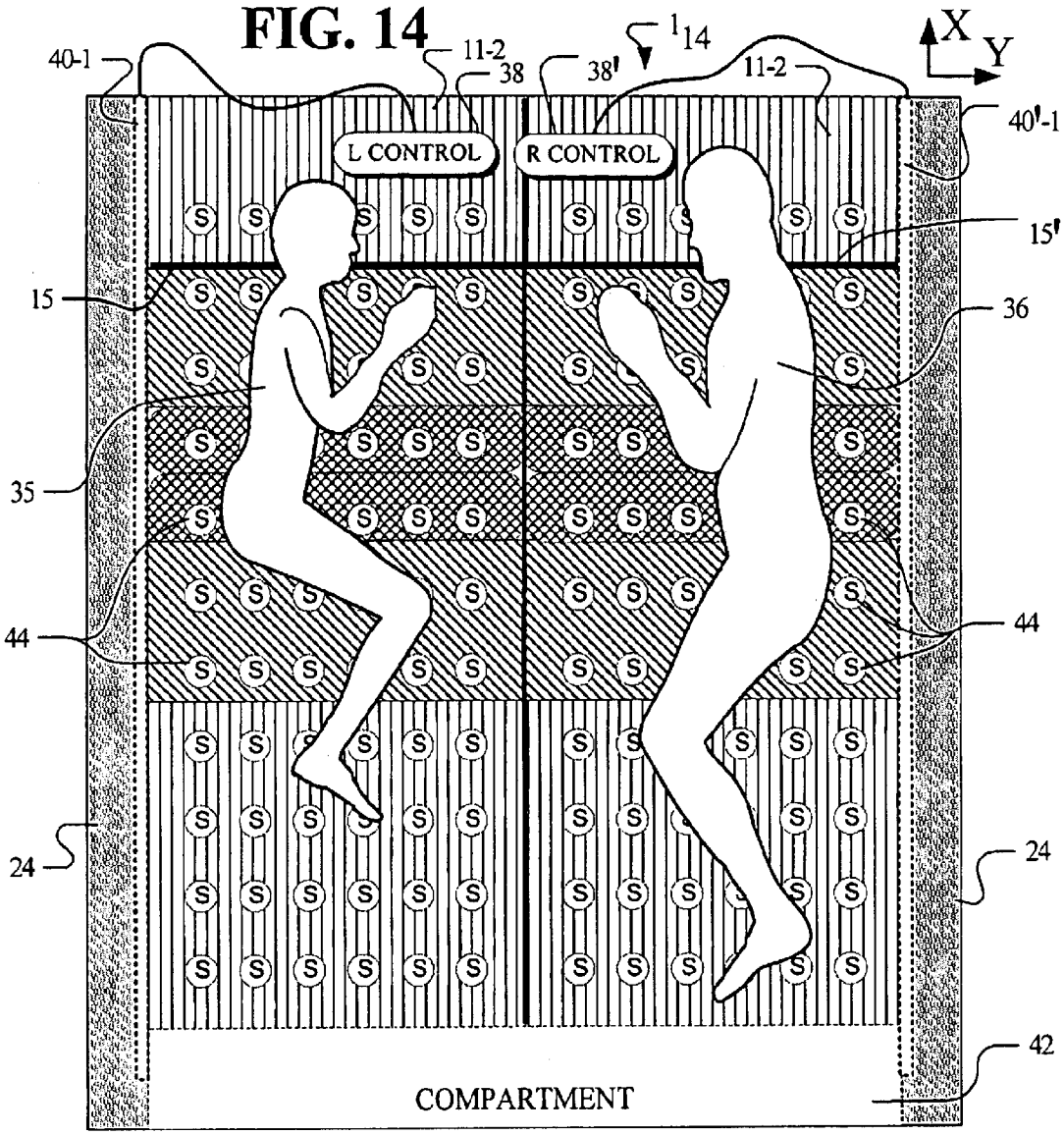
FIG. 14 depicts a top view of another embodiment of the mattress of FIG. 3 with a Caucasian female of 2.5 percentile body dimensions reclining on her side on the left and a Caucasian male of 97.5 percentile body dimensions reclining on his side on the right with a compartment for housing a pressure unit and controls.

FIG. 14 depicts a top view of one embodiment of the mattress of FIG. 3 with a Caucasian female, with 2.5 percentile body dimensions, on her side on the left and a Caucasian male, with 97.5 percentile body dimensions, on his side on the right. In FIG. 14, the upper layers of foam for the mattress of FIG. 3 have been stripped away to show the lifts 12 and 12' and the head and leg foam members 11-2 and 11-7, respectively. The lifts 12 and 12' are separated from the foam members 11-2 by lateral slots 15 and 15', respectively. Also, a longitudinal slot 15" extends between the left and right sides of mattress $\mathbf{1}_{14}$. The foam material 24 extends around the left and right sides and along the foot of mattress $\mathbf{1}_{14}$. A plurality of sensors 44 are positioned above the lifts 12 and 12'. The sensors 44 are arrayed in the XY-plane as shown in FIG. 14 so as to be able to sense the local displacement of parts of the body. The number of sensor employed is a function of the resolution desired for body sensing. Good resolution can be obtained with 400 sensors but a greater number or a lessor number can be satisfactorily employed. FIG. 14 depicts 66 sensors per left and right side for a total of 122 sensors. Different vertical locations of sensors 44 are acceptable. In FIG. 14, the sensors are located on top of the lifts 12-1, 12-2, 12-3 and 12-4 and on top of members 11-2 and 11-7 (see FIG. 3). The sensors 44 also can be located on or in any other members such as on top of members 11-1, 11-4 and 11-6 in FIG. 3. Also, referring to FIG. 3, the sensors 44 can be located on top of member $\mathbf{22}_3$-1, on top of member $\mathbf{22}_3$-2 or at any other location in the vertical Z-axis direction. In one embodiment and referring to FIG. 3, the top member $\mathbf{22}_3$-1 is split into two layers, for example, each 1 inch thick, and the sensors are located between the two 1 inch layers. The sensors 44 function to sense local proximity, local pressure and/or local strain at many locations of the mattress $\mathbf{1}_{14}$. The information from sensors 44 when periodically recorded provides information about body position and sleep patterns of a body on the mattress $\mathbf{1}_{14}$.

A compartment 42 for housing the pressure unit 7 of FIG. 13 is located at the foot of the mattress $\mathbf{1}_{14}$ and connects with channels 40-1 and 40'-1 for air tubes running to the lifts 12 and 12' and for electrical control lines running to the left control device 38 and the right control device 38'.

The female body 36 has access to the left control device 38 for controlling the pressure unit 7 to inflate or deflate the lifts 12. The lift 12-1 is under the shoulder region, the lifts 12-2 and 12-3 are under the waist region with lift 12-3 toward the hip region and the lift 12-4 is under the hip region. The shoulder lift 12-1 is controlled by the air valve 37-1, the waist lift 12-2 is controlled by the air valve 37-2, the waist-hip lift 12-3 is controlled by the valve 37-3 and the hip lift 12-4 is controlled by the hip valve 37-4. Each of the valves 37-1, 37-2, 37-3 and 37-4 operates to increase the pressure in a corresponding lift 12 by connecting a higher pressure from pressure source 39 to the lift. Each of the valves 37-1, 37-2, 37-3 and 37-4 operates to decrease the pressure in a corresponding lift 12 by connecting a lower pressure from pressure source 39 to the lift or by venting the lift to the atmosphere.

The male body 35 has access to the right control device 38' for controlling the pressure unit 7 to inflate or deflate the lifts 12'. The lift 12'-1 is under the shoulder region, the lifts 12'-2 and 12'-3 are under the waist region with lift 12'-2 toward the shoulder region and the lift 12'-4 is under the hip region. The shoulder lift 12'-1 is controlled by the air valve 37'-1, the waist lift 12'-2 is controlled by the air valve 37'-2, the waist-hip lift 12'-3 is controlled by the valve 37'-3 and the hip lift 12'-4 is controlled by the hip valve 37'-4. Each of the valves 37'-1, 37'-2, 37'-3 and 37'-4 operates to increase the pressure in a corresponding lift 12' by connecting a higher pressure from pressure source 39 to the lift. Each of the valves 37'-1, 37'-2, 37'-3 and 37'-4 operates to decrease the pressure in a corresponding lift 12' by connecting a lower pressure from pressure source 39 to the lift or by venting the lift to the atmosphere.

Figure 15:
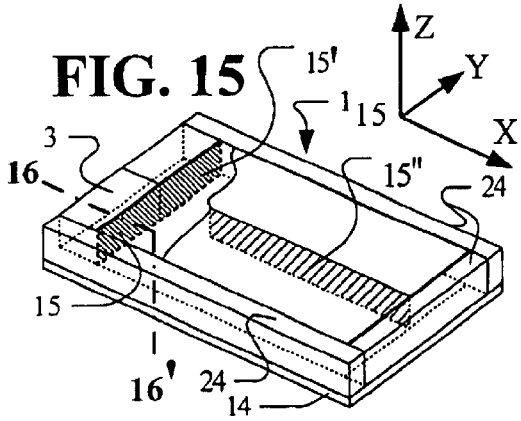
FIG. 15 depicts an isometric view of a mattress having a lateral slot between the head portion and the shoulder portion.

FIG. 15 depicts an isometric cutaway view of a mattress $\mathbf{1}_{15}$ like the mattress of FIG. 3 having a lateral slot 15/15' between the head portion and the shoulder portion and a longitudinal slot 15" between the left and right sides. The mattress $\mathbf{1}_{15}$ includes a bottom foam member 14 and a firm foam member 24 that is around the perimeter on three sides.

Figure 16:
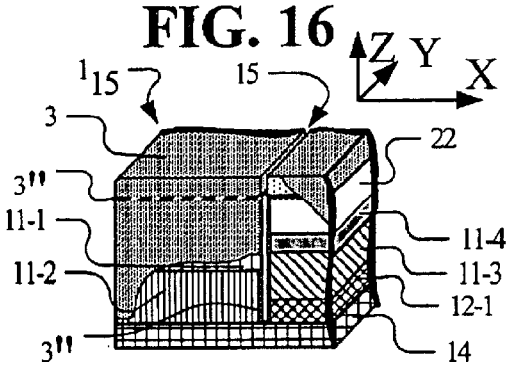
FIG. 16 depicts an isometric view of a cutaway section of a mattress having a lateral slot between the head portion and the shoulder portion as shown in FIG. 15.

FIG. 16 depicts an isometric view of a detailed cutaway section along section line 16-16' of FIG. 15 of the mattress $\mathbf{1}_{15}$ of FIG. 15 having a lateral slot 15 between the head foam members 11-1 and 11-2 and the shoulder members 12-1, 11-3 and 11-4. The lateral slot 15 also extends through the top member 22. The covering 3 covers the mattress $\mathbf{1}_{15}$ and has a bottom surface material 3" that extends down one side of the lateral slot 15 and up the other so that the lateral slot is lined with cover bottom material.

Figure 17:
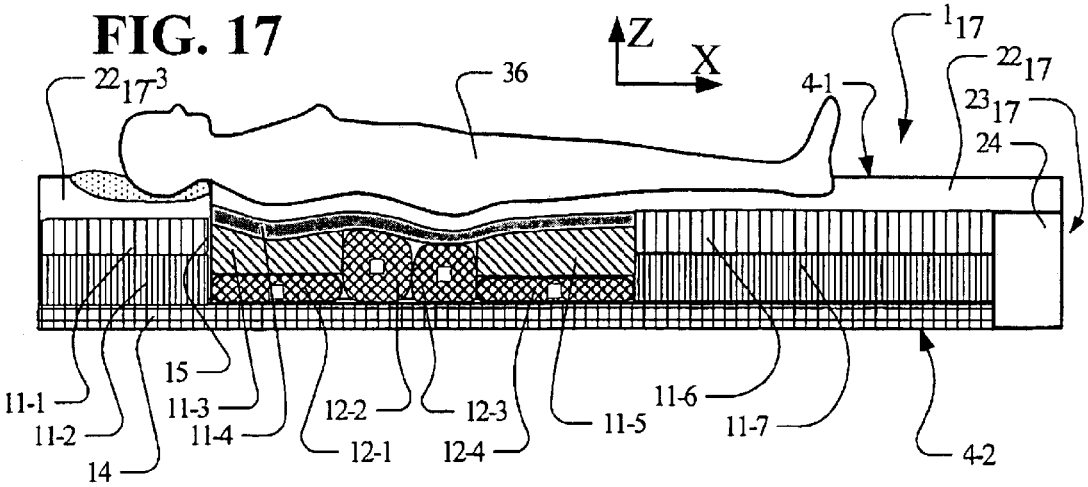
FIG. 17 depicts a side view of the mattress of FIG. 3 tuned for a Caucasian female of a 2.5 percentile body dimensions reclining on her back.

FIG. 17 depicts a side view of the mattress of FIG. 3 tuned for a Caucasian female body 36, having 2.5 percentile body dimensions, reclining on her back.

In FIG. 17, the top member $\mathbf{22}_{17}$ has a top surface 4-1 that has been depressed by the body 36 so that it follows the curvature of the body. The top member $\mathbf{22}_{17}$ is in contact with the body and functions to support and distribute the weight of the body in cooperation with resilient supporting means $\mathbf{23}_{17}$. The top member $\mathbf{22}_{17}$ is formed, for example, by one layer of constant thickness foam having uniform displacement parameters for providing a uniform supporting surface pressure to the reclining body 36. In an alternate embodiment, top member $\mathbf{22}_{17}$ is formed of two layers, each of constant thickness foam, so that the two layers together have uniform displacement parameters for providing a uniform supporting surface pressure to the reclining body 36. A pillow 20 is positioned under the head of body 36.

In a $1^{ST}$ region, the head section includes the foam members 11-1 and 11-2 for supporting the head part of reclining body 36. The foam members 11-1 and 11-2 undergo only a small compression and provide appropriate displacement parameters for the head part of the side-lying female body 36. The shoulder section includes the foam member 11-3, foam member 11-4 and lift 12-1. The foam member 11-3, foam member 11-4 and top member $\mathbf{22}_{17}$ have substantial compression in response to the shoulder of the reclining body 36. The lift 12-1 is for adjusting the vertical elevation of mattress $\mathbf{1}_{17}$ in the shoulder region, if necessary, but in FIG. 17 the vertical elevation imparted by lift 12-1 is about the same as in FIG. 3. Together the foam member 11-3, foam member 11-4 and top member $\mathbf{22}_{17}$ and lift 12-1 provide appropriate displacement parameters for the shoulder part of the female body 36.

In a $2^{ND}$ region, the waist section includes the lifts 12-2 and 12-3 and the foam member 11-4 for supporting the waist part of reclining body 36. The lifts 12-2 and 12-3 are adjusted so that the vertical elevation imparted to the mattress $\mathbf{1}_{17}$ is higher for lift 12-2, which is under the waist region of the reclining body 36, than the vertical elevation imparted by lift 12-3 which is closer to the hip part of the reclining body 36. Together the top member $\mathbf{22}_{17}$ lifts 12-2 and 12-3 and foam member 11-4 provide appropriate displacement parameters for the waist part of the female body 36.

In a $3^{RD}$ region, the hip section includes the lift 12-4 and possibly the lift 12-3, as a function of the size of the body 36, foam member 11-5 and foam member 11-4. The foam members 11-4 and 11-5 are compressed by the hip of the reclining body 36. The lift 12-4 adjusts the vertical elevations of mattress $\mathbf{1}_{17}$ in the hip region but in FIG. 6 the vertical elevation imparted by lift 12-4 is about the same as in FIG. 3. Together the top member $\mathbf{22}_{17}$, lift 12-4, foam member 11-5 and foam member 11-4 provide appropriate displacement parameters for the hip part of the female body 36. In the leg section, the foam members 11-6 and 11-7 have slight compression in response to the legs of the reclining body 36. The foam members 11-6 and 11-7 together with the top member $\mathbf{22}_{17}$ provide appropriate displacement parameters for the leg part of the female body 36.

Figure 18:
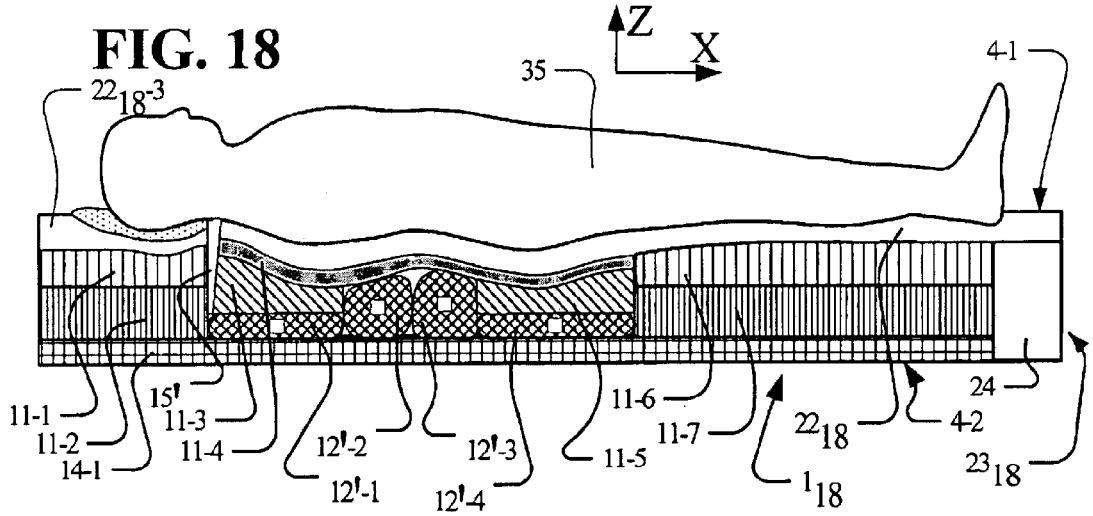
FIG. 18 depicts a side view of the mattress of FIG. 3 tuned for a Caucasian male of a 97.5 percentile body dimensions reclining on his back.

FIG. 18 depicts a side view of the mattress of FIG. 3 tuned for a Caucasian male body 35, having 97.5 percentile body dimensions, reclining on his back.

In FIG. 18, the top member $\mathbf{22}_{18}$ has a top surface 4-1 that has been depressed by the body 35 so that it follows the curvature of the body. The top member $\mathbf{22}_{18}$ is in contact with the body and functions to support and distribute the weight of the body in cooperation with resilient supporting means $\mathbf{23}_{18}$. The top member $\mathbf{22}_{18}$ is formed, for example, by one layer of constant thickness foam having uniform displacement parameters for providing a uniform supporting surface pressure to the reclining body 35. In an alternate embodiment, top member $\mathbf{22}_{18}$ is formed of two layers, each of constant thickness foam, so that the two layers together have uniform displacement parameters for providing a uniform supporting surface pressure to the reclining body 35. A pillow 20 is positioned under the head of body 35.

In a $1^{ST}$ region, the head section includes the foam members 11-1 and 11-2 for supporting the head part of reclining body 35. The foam members 11-1 and 11-2 undergo only a small compression and provide appropriate displacement parameters for the head part of the male body 35. The shoulder section includes the foam member 11-3, the foam member 11-4 and the lift 12'-1. The foam member 11-3, the foam member 11-4 and the top member $\mathbf{22}_{18}$ have substantial compression in response to the shoulder of the reclining body 35. The lift 12'-1 is for adjusting the vertical elevation of mattress $\mathbf{1}_{18}$ in the shoulder region, if necessary, but in FIG. 18 the vertical elevation imparted by lift 12'-1 is about the same as in FIG. 3. Together the foam member 11-3, foam member 11-4 and top member $\mathbf{22}_{18}$ and lift 12'-1 provide appropriate displacement parameters for the shoulder part of the male body 35.

In a $2^{ND}$ region, the waist section includes the lifts 12'-2 and 12'-3 and the foam member 11-4 for supporting the waist part of reclining body 35. The lifts 12'-2 and 12'-3 are adjusted so that the vertical elevation imparted to the mattress $\mathbf{1}_{18}$ is higher for lift 12'-3, which is under the waist region of the reclining body 35, than the vertical elevation imparted by lift 12'-2 which is closer to the shoulder part of the reclining body 35. Together the top member $\mathbf{22}_{18}$, lifts 12'-2 and 12'-3 and foam member 11-4 provide appropriate displacement parameters for the waist part of the male body 35.

In a $3^{RD}$ region, the hip section includes the lift 12'-4, the foam member 11-4 and the foam member 11-5. The foam members 11-4 and 11-5 are compressed by the hip of the reclining body 35. The lift 12'-4 adjusts the vertical elevations of mattress $\mathbf{1}_{18}$ in the hip region but in FIG. 6 the vertical elevation imparted by lift 12'-4 is about the same as in FIG. 3. Together the top member $\mathbf{22}_{18}$, lift 12'-4, foam member 11-5 and foam member 11-4 provide appropriate displacement parameters for the hip part of the male body 35. In the leg section, the foam members 11-6 and 11-7 have slight compression in response to the legs of the reclining body 35. The foam members 11-6 and 11-7 together with the top member $\mathbf{22}_{18}$ provide appropriate displacement parameters for the leg part of the side-lying male body 35.

Figure 19:
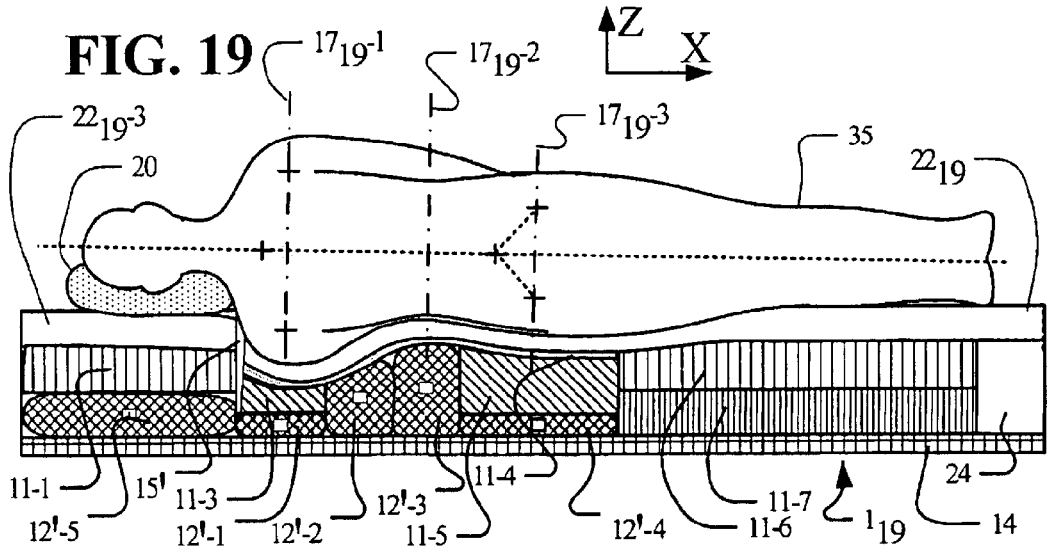
FIG. 19 depicts a side view of a mattress having five dynamic air-inflated adjusting members for tuning the mattress for body alignment and low contact pressure and tuned for a Caucasian male of a 97.5 percentile body dimensions reclining on his side.

FIG. 19 depicts a side view of a body 35 on a mattress $\mathbf{1}_{19}$, like the mattress of FIG. 3 except having five dynamic air-inflated adjusting lifts 12'. The five dynamic lifts 12' are for tuning the mattress $\mathbf{1}_{19}$ for body alignment and low contact pressure and are tuned for a Caucasian male of a 97.5 percentile body dimensions in a side-lying position. The lifts 12'-1, 12'-2, 12'-3 and 12'-4 operate in the same manner as in FIG. 3. The additional lift 12'-5 operates to set the elevation level for the head and coacts with the foam member 11-1, the top member $\mathbf{22}_{19}$ and the pillow 20. The lift 12'-5, the foam member 11-1, the head piece member $\mathbf{22}_{19}$-3 of the top member $\mathbf{22}_{19}$ and the pillow 20 cooperate to provide appropriate displacement parameters for the head part of the side-lying male body 35.

Figure 20:
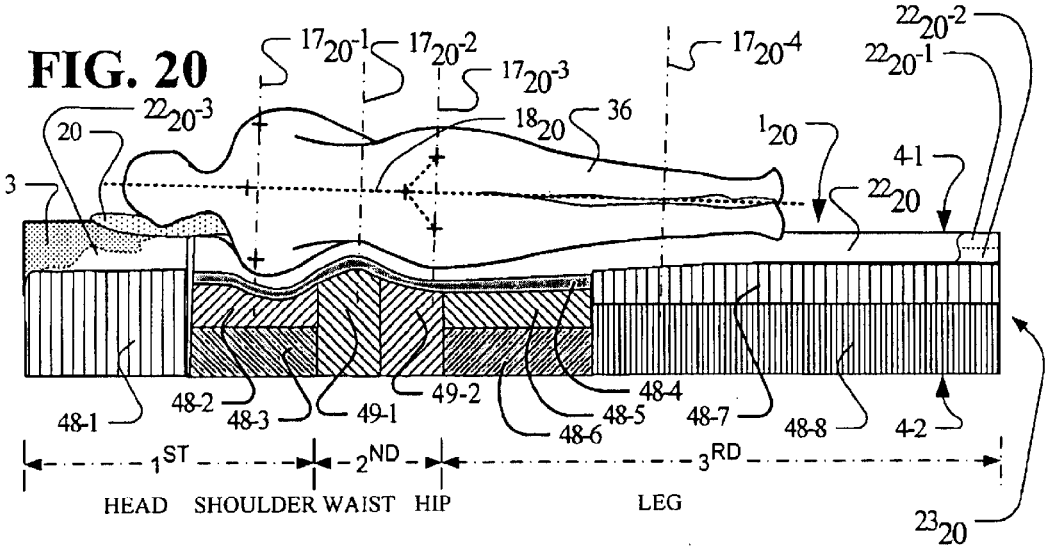
FIG. 20 depicts a side view of a mattress having static members that configure the mattress to establish body alignment and low contact pressure for a Caucasian female of a 2.5 percentile body dimensions reclining on her side.

FIG. 20 depicts a side view of a mattress $\mathbf{1}_{20}$ having static members 49-1 and 49-2 for establishing the mattress $\mathbf{1}_{20}$ for body alignment and uniform low contact pressure with a Caucasian female body 36 of 2.5 percentile body dimensions reclining on her side.

In FIG. 20, the top member $\mathbf{22}_{20}$ has a top surface 4-1 that has been depressed by the body 36 so that it follows the curvature of the body. The top member $\mathbf{22}_{20}$ is in contact with the body and functions to support and distribute the weight of the body in cooperation with resilient supporting means $\mathbf{23}_{20}$. The top member $\mathbf{22}_{20}$ is formed, for example, by one layer of constant thickness foam having uniform displacement parameters for providing a uniform supporting surface pressure to the reclining body 36. In an alternate embodiment, top member $\mathbf{22}_{20}$ is formed of two layers, each of constant thickness foam, so that the two layers together have uniform displacement parameters for providing a uniform supporting surface pressure to the reclining body 36. A pillow 20 is positioned under the head of body 36, rests on the covering 3 (shown cut away) and is on the head piece member $\mathbf{22}_{20}$-3 of top member $\mathbf{22}_{20}$. Head piece member $\mathbf{22}_{20}$-3 is the same material as and separated from the top member $\mathbf{22}_{20}$ by lateral slot 15.

In a $1^{ST}$ region, the head section includes the foam member 48-1 and the top member piece $\mathbf{22'}_{20}$ for supporting the head part of reclining body 36. The foam member 48-1 undergoes only a small compression and with the top member piece $\mathbf{22'}_{20}$ provides appropriate displacement parameters for the head part of the side-lying female body 36. The shoulder section includes the foam members 48-2, 48-3 and 48-4. The foam members 48-2, 48-3 and 48-4 and the top member $\mathbf{22}_{20}$ are substantially compressed by the shoulder of the reclining body 36. Together foam members 48-2, 48-3 and 48-4 and the top member $\mathbf{22}_{20}$ provide appropriate displacement parameters for the shoulder part of the side-lying female body 36.

In a $2^{ND}$ region, the waist section includes foam members 49-1 and 49-2 and the foam member 48-4 for supporting the waist part of reclining body 36. The foam members 49-1 and 49-2 are positioned so that the vertical elevation imparted to the mattress $\mathbf{1}_{20}$ is higher for foam member 49-1, which is under the waist region of the reclining body 36, than the vertical elevation imparted by foam member 49-2 where member 49-2 is closer to the hip part of the reclining body 36. Together the top member $\mathbf{22}_{20}$, foam members 49-1 and 49-2 and foam member 48-4 provide appropriate displacement parameters for the waist part of the side-lying female body 36.

In a $3^{RD}$ region, the hip section includes top member $\mathbf{22}_{20}$ and foam members 48-4, 48-5 and 48-6 that are compressed by the hip of the reclining body 36. Together, top member $\mathbf{22}_{20}$ and foam members 48-4, 48-5 and 48-6 provide appropriate displacement parameters for the hip part of the side-lying female body 36. In the leg section, the foam members 48-7 and 48-8 are slightly compressed by the legs of the reclining body 36. The foam members 48-7 and 48-8 together with the top member $\mathbf{22}_{20}$ provide appropriate displacement parameters for the leg part of the side-lying female body 36.

In FIG. 20, the shoulders have an alignment line $\mathbf{17}_{20}$-1, the waist has an alignment line $\mathbf{17}_{20}$-2, the hips have an alignment line $\mathbf{17}_{20}$-3, the legs have an alignment line $\mathbf{17}_{20}$-4 and the spine has an alignment line $\mathbf{18}_{20}$. In FIG. 20, the waist of the body is elevated so that the spine and the spine alignment line $\mathbf{18}_{20}$ are straight. The surface pressures at the shoulder alignment line $\mathbf{17}_{20}$-1, the waist alignment line $\mathbf{17}_{20}$-2, the hip alignment line $\mathbf{17}_{20}$-3 and the leg alignment line $\mathbf{17}_{20}$-4 are typically low and below a low pressure threshold. For a bed made of properly selected foams and other materials, the low pressure threshold is below the ischemic pressure of about 30 mmHg.

In one embodiment, the mattress of FIG. 20 has the displacement parameters established using the following materials shown in TABLE 4.

TABLE 4

| Member | 48-1 | 48-2 | 48-3 | 48-4 | 48-5 | 48-6 | 48-7 | 48-8 | 49-1 | 49-2 | $22_{20}$-1 | $22_{20}$-1 | $22_{20}$-3 |
|---|---|---|---|---|---|---|---|---|---|---|---|---|---|
| IFD | 28R | 15R | 15R | 24R | 15R | 15R | 15R | 28R | 28HR | 15R | 15R | 24R | 6R |
| Thickness | 8 in | 3 in | 3.5 in | 1.5 in | 3 in | 3.5 in | 3 in | 5 in | 8 in | 8 in | 2.5 in | 1.5 in | 4 in |

Note in TABLE 4 and FIG. 20 that the top member $\mathbf{22}_{20}$ is formed by a composite of two members, $\mathbf{22}_{20}$-1 and $\mathbf{22}_{20}$-2 and a head member $\mathbf{22}_{20}$-3, where member $\mathbf{22}_{20}$-1 is 2.5 inches thick, member $\mathbf{22}_{20}$ is 1.5 inches thick and member $\mathbf{22}_{20}$-3 is 4 inches thick where member $\mathbf{22}_{20}$-1 is on top of member $\mathbf{22}_{20}$-2. With the dimensions of TABLE 4, the mattress $\mathbf{1}_{20}$ is 12 inches thick without accounting for the thickness of the covering 3 which is approximately 1.5 to 2 inches so that the overall mattress $\mathbf{1}_{20}$ is up to approximately 14 inches thick and in standard widths and lengths.

In another embodiment, the mattress of FIG. 20 has the displacement parameters established using the materials in the following TABLE 5.

TABLE 5

| Member | 48-1 | 48-2 | 48-3 | 48-4 | 48-5 | 48-6 | 48-7 | 48-8 | 49-1 | 49-2 | $22_{20}$-1 | $22_{20}$-2 | $22_{20}$-3 |
|---|---|---|---|---|---|---|---|---|---|---|---|---|---|
| IFD | 28R | 15R | 15R | 24R | 15R | 15R | 15R | 28R | 28R | 15R | 15R | 24R | 6R |
| Thickness | 6 in | 3 in | 2 in | 1 in | 3 in | 2 in | 3 in | 3 in | 5 in | 5 in | 2 in | 2 in | 4 in |

Note in TABLE 5 that the top member $\mathbf{22}_{20}$ is formed by a composite of two members $\mathbf{22}_{20}$-1 and $\mathbf{22}_{20}$-2 and a head member $\mathbf{22}_{20}$-3, where member $\mathbf{22}_{20}$-1 is 2 inches thick, member $\mathbf{22}_{20}$ is 2 inches thick and member $\mathbf{22}_{20}$-3 is 4 inches thick where member $\mathbf{22}_{20}$-1 is on top of member $\mathbf{22}_{20}$-2. The members $\mathbf{22}_{20}$-1 and $\mathbf{22}_{20}$-2 are separated from the member $\mathbf{22}_{20}$-3 by the lateral slot 15 to permit free depression by the shoulder of a body. With the dimensions of TABLE 5, the mattress 120 is 10 inches thick without accounting for the thickness of the covering 3 which is approximately 1.5 to 2 inches so that the overall mattress $\mathbf{1}_{20}$ is approximately up to 12 inches thick and in standard widths and lengths.

Figure 21:
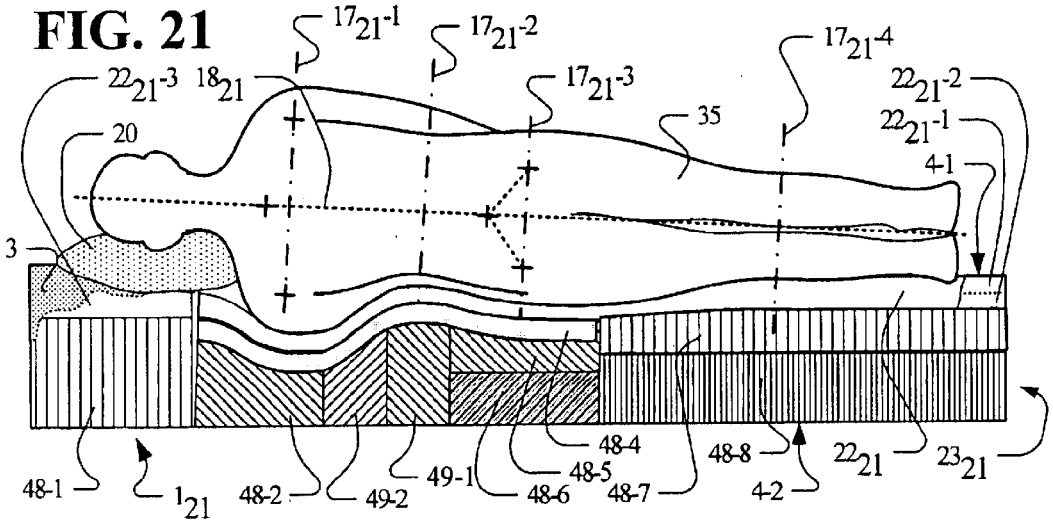
FIG. 21 depicts a side view of a mattress having static members that configure the mattress to establish body alignment and low contact pressure for a Caucasian male of a 97.5 percentile body dimensions reclining on his side.

FIG. 21 depicts a side view of a mattress $\mathbf{1}_{21}$ having static members 49-1 and 49-2 for establishing the mattress $\mathbf{1}_{21}$ for body alignment and uniform low contact pressure with a Caucasian male body 35 of 97.5 percentile body dimensions reclining on his side.

In FIG. 21, a resilient top member $\mathbf{22}_{21}$ has a top surface 4-1 that has been depressed by the body 35 so that it follows the curvature of the body. The resilient top member $\mathbf{22}_{21}$ is in contact with the body and functions to support and distribute the weight of the body in cooperation with resilient supporting means $\mathbf{23}_{21}$. The top member $\mathbf{22}_{21}$, is formed, for example, by one layer of constant thickness foam having uniform displacement parameters for providing a uniform supporting surface pressure to the reclining body 35. In an alternate embodiment, top member $\mathbf{22}_{21}$ is formed of two members $\mathbf{22}_{21}$-1 and $\mathbf{22}_{21}$-2, each of a constant thickness foam, so that the two layers together have uniform displacement parameters for providing a uniform supporting surface pressure to the reclining body 35. A pillow 20 is positioned under the head of body 35 and is positioned on cover 3 (shown cutaway) on head member $\mathbf{22}_{21}$-3.

In a $1^{ST}$ region, the head section includes the foam member 48-1 and a foam top member $\mathbf{22}_{21}$-3 for supporting the head part of reclining body 35. The foam members $\mathbf{22}_{21}$-3 and 48-1 undergo only small compressions and provide appropriate displacement parameters for the head part of the side-lying male body 35. The shoulder section includes the foam members 48-2 and 48-4. The foam members 48-2 and 48-4 and the top member $\mathbf{22}_{21}$ are substantially compressed by the shoulder of the reclining body 35. Together foam members 48-2 and 48-4 and the top member $\mathbf{22}_{21}$, provide appropriate displacement parameters for the shoulder part of the side-lying male body 35.

In a $2^{ND}$ region, the waist section includes foam members 49-1 and 49-2 and the foam member 48-4 for supporting the waist part of reclining body 35. The foam members 49-1 and 49-2 are positioned so that the vertical elevation imparted to the mattress $\mathbf{1}_{21}$is higher for foam member 49-1, which is under the waist region of the reclining body 35, than the vertical elevation imparted by foam member 49-2 where member 49-2 is closer to the shoulder part of the reclining body 35. Together the top member $\mathbf{22}_{21}$, foam members 49-1 and 49-2 and foam member 48-4 provide appropriate displacement parameters for the waist part of the side-lying male body 35.

In a $3^{RD}$ region, the hip section includes top member $\mathbf{22}_{21}$, and foam members 48-4, 48-5 and 48-6 that are compressed by the hip of the reclining body 35. Together top member $\mathbf{22}_{21}$ and foam members 48-4, 48-5 and 48-6 provide appropriate displacement parameters for the hip part of the side-lying male body 35. In the leg section, the foam members 48-7 and 48-8 are slightly compressed by the legs of the reclining body 35. The foam members 48-7 and 48-8 together with the top member $\mathbf{22}_{21}$ provide appropriate displacement parameters for the leg part of the side-lying male body 35.

In FIG. 21, the shoulders have an alignment line $\mathbf{17}_{21}$-1, the waist has an alignment line $\mathbf{17}_{21}$-2, the hips have an alignment line $\mathbf{17}_{21}$-3, the legs have an alignment line $\mathbf{17}_{21}$-4 and the spine has an alignment line $\mathbf{18}_{21}$. In FIG. 21, the waist of the body is elevated so that the spine and the spine alignment line $\mathbf{18}_{21}$ are straight. The surface pressures at the shoulder alignment line $\mathbf{17}_{21}$-1, the waist alignment line $\mathbf{17}_{21}$-2, the hip alignment line $\mathbf{17}_{21}$-3 and the leg alignment line $\mathbf{17}_{21}$-4 are typically low and below a low pressure threshold. For a bed made of properly selected foams and other materials, the low pressure threshold is below the ischemic pressure of about 30 mmHg.

Figure 22:
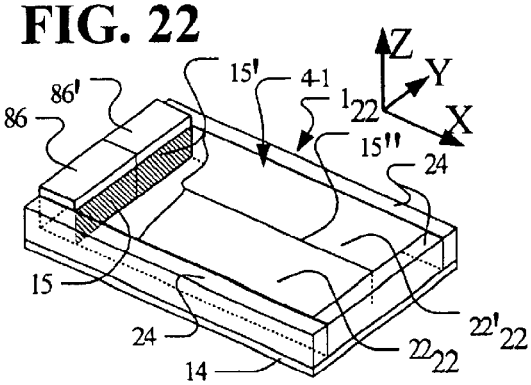
FIG. 22 depicts an isometric view of a mattress having a raised head section.

FIG. 22 depicts an isometric view of a mattress $\mathbf{1}_{22}$ having raised head sections 86 and 86' on the left and right, respectively, for a female body 36 and a male body 35, respectively, as shown in FIG. 14, for example. The mattress $\mathbf{1}_{22}$ includes lateral slots 15 and 15' between the head sections 86 and 86', respectively, and the top members $\mathbf{22}_{22}$ and $\mathbf{22'}_{22}$, respectively. The mattress $\mathbf{1}_{22}$ includes a longitudinal slot 15" between the left and right sides of the mattress including top members $\mathbf{22}_{22}$ and $\mathbf{22'}_{22}$. The raised head sections 86 and 86' are used in conjunction with a pillow or without a pillow to establish greater elevation in the head region.

Figure 23:
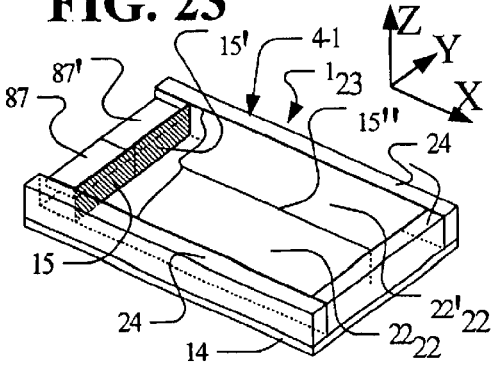
FIG. 23 depicts an isometric view of a mattress having a lowered head section.

FIG. 23 depicts an isometric view of a mattress $\mathbf{1}_{23}$ having lowered head sections 87 and 87' on the left and right, respectively, for a female body 36 and a male body 35, respectively, as shown in FIG. 14, for example. The mattress $\mathbf{1}_{23}$ includes lateral slots 15 and 15' between the head sections 87 and 87', respectively, and the top members $\mathbf{22}_{22}$ and $\mathbf{22'}_{22}$, respectively. The mattress $\mathbf{1}_{22}$ includes a longitudinal slot 15" between the left and right sides of the mattress including top members $\mathbf{22}_{22}$ and $\mathbf{22'}_{22}$. The lowered head sections 87 and 87' can be used in conjunction with a conventional pillow or with a pillow especially adapted to fit within the depressions at sections 87 and 87' to establish proper elevation in the head region.

Figure 24:
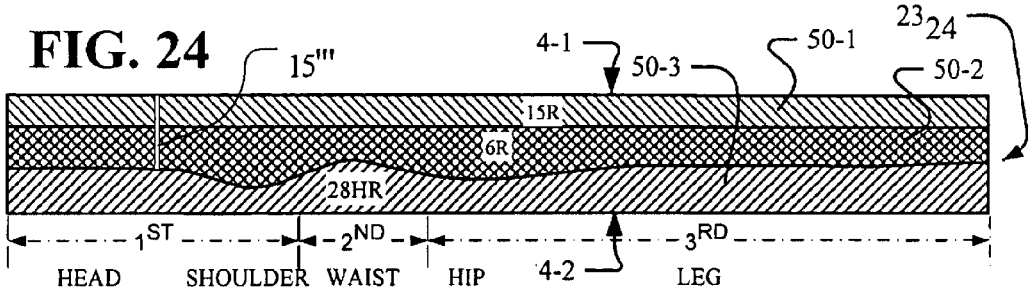
FIG. 24 depicts a side view of a mattress having a single top layer over two mating and variable thickness members designed for body alignment and low contact pressure of an average female.

FIG. 24 depicts a side view of a mattress $\mathbf{1}_{24}$ having a uniform resilient top member 50-1 over a resilient supporting means $\mathbf{23}_{24}$ formed of two mating and variable thickness members 50-2 and 50-3. The mattress $\mathbf{1}_{24}$ has a uniformly flat top surface 4-1 and a uniformly flat bottom surface 4-2. The mattress $\mathbf{1}_{24}$ is designed for body alignment and low contact pressure of a typical female body.

In FIG. 24, the mattress $\mathbf{1}_{24}$ is typically supported by a conventional foundation, such as foundation 26 in FIG. 1, on bottom surface 4-2. In the FIG. 24 embodiment, the resilient top member 50-1 constitutes a uniform top region below the top surface 4-1 for supporting and distributing the weight of a reclining body in cooperation with resilient supporting means $\mathbf{23}_{24}$. The top member 50-1 is formed, for example, by one or more layers of foam having uniform displacement parameters for providing a uniform supporting surface pressure to a reclining body. In one embodiment, the members 50-1, 50-2 and 50-3. have ILD's of 15R, 6R and 28HR, respectively, so that the members 50-1, 50-2 and 50-3 are medium, soft and firm, respectively.

In FIG. 24, the mattress $\mathbf{1}_{24}$ is formed of multiple members that extend in the XY-plane (a plane normal to the page of the drawing) to establish different displacement parameters that help determine the mattress compression in the longitudinal direction for alignment of the head, shoulder, waist, hip and leg parts of a reclining body at low supporting body surface pressure.

In one embodiment, the resilient top member 50-1 and the resilient supporting means $\mathbf{23}_3$ have a lateral slot 15'" that extends through top member 50-1 from the top surface 4-1 to and partially through the resilient supporting means $\mathbf{23}_3$ to the top of bottom member 50-3. The slot 15'" extends laterally across (in a direction normal to the page in FIG. 24 like the slots 15/15' in FIG. 15) the mattress $\mathbf{1}_{24}$. The slot 15'" functions to relieve tension forces that would otherwise be created by shoulder depression into members 50-1 and 50-2 of the mattress $\mathbf{1}_{24}$.

In FIG. 24, the members 50-2 and 50-3 with irregular internal surfaces are manufactured, for example, by contour cutting regular constant thickness foam members. Techniques for contour cutting of foam are well known.

Figure 25:
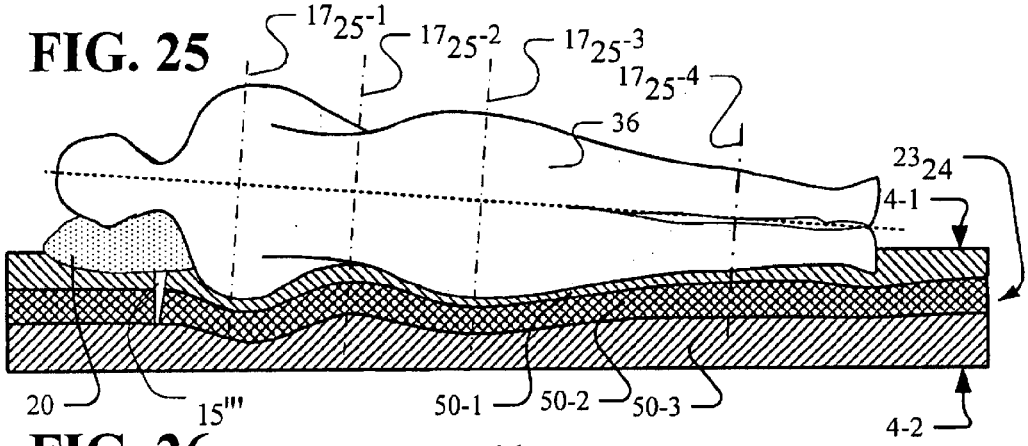
FIG. 25 depicts a side view of the mattress of FIG. 24 together with an average female reclining on her side.

FIG. 25 depicts a side view of the mattress of FIG. 24 together with a female body 36 of 70 percentile body dimensions reclining on her side.

In FIG. 25, the resilient top member 50-1 has a top surface 4-1 that has been depressed by the body 36 so that it follows the curvature of the body. The top member 50-1 is in contact with the body (through a cover like cover 3 in FIG. 3) and functions to support and distribute the weight of the body in cooperation with resilient supporting means $\mathbf{23}_{24}$. The top member 50-1 is formed, for example, by one layer of constant thickness foam having uniform displacement parameters for providing a uniform supporting surface pressure to the reclining body 36. A pillow 20 is positioned under the head of body 36.

In the $1^{ST}$ region, the head section includes the foam members 50-1, 50-2 and 50-3 for supporting the head part of reclining body 36 where the firmer member 50-3 is the thickest and members 50-1 and 50-2 are about the same thickness in the uncompressed state (see FIG. 24). The foam members 50-1, 50-2 and 50-3 undergo only a small compression in the head section and provide appropriate displacement parameters for the head part of the side-lying female body 36. The shoulder section includes the foam members 50-1, 50-2 and 50-3 where in the uncompressed state (see FIG. 24) the softer member 50-2 is the thickest. The foam members 50-1, 50-2 and 50-3 are substantially compressed by the shoulder of the reclining body 36. Together, in the shoulder region, the foam members 50-1, 50-2 and 50-3 provide appropriate displacement parameters for the shoulder part of the side-lying female body 36.

In the $2^{ND}$ region, the waist section includes the foam members 50-1, 50-2 and 50-3 for supporting the waist part of reclining body 36 where the softer member 50-2 is the thinnest and where the firmer member 50-3 is the thickest. Together, in the waist region, the foam members 50-1, 50-2 and 50-3 provide appropriate displacement parameters for the waist part of the side-lying female body 36.

In the $3^{RD}$ region, the hip section includes foam members 50-1, 50-2 and 50-3 for supporting the hip part of the reclining body 36 where, in the uncompressed state (see FIG. 24), the firmer member 50-3 is the thickest and members 50-1 and 50-2 are about the same thickness. Together, in the hip section, foam members 50-1, 50-2 and 50-3 provide appropriate displacement parameters for the hip part of the side-lying female body 36. In the leg section, foam members 50-1, 50-2 and 50-3 are for supporting the leg part of the reclining body 36 where, in the uncompressed state (see FIG. 24), the firmer member 50-3 is the thickest and members 50-1 and 50-2 are about the same thickness. Together, in the leg section, foam members 50-1, 50-2 and

50-3 provide appropriate displacement parameters for the leg part of the side-lying female body 36.

In FIG. 25, the shoulders have an alignment line $\mathbf{17}_{25}$-1, the waist has an alignment line $\mathbf{17}_{25}$-2, the hips have an alignment line $\mathbf{17}_{25}$-3, the legs have an alignment line $\mathbf{17}_{25}$-4 and the spine has an alignment line $\mathbf{18}_{25}$. In FIG. 25, the waist of the body is straight so the spine alignment line $\mathbf{18}_{25}$ is straight. The surface pressures $T_1$, $T_2$, $T_3$ and $T_4$ at the shoulder alignment line $\mathbf{17}_{25}$-1, waist alignment line $\mathbf{17}_{25}$-2, the hip alignment line $\mathbf{17}_{25}$-3 and the leg alignment line $\mathbf{17}_{25}$-4 are typically low and below a low pressure threshold. For a bed made of properly selected foams and other materials, the low pressure threshold is below the ischemic pressure of about 30 mmHg.

Figure 26:
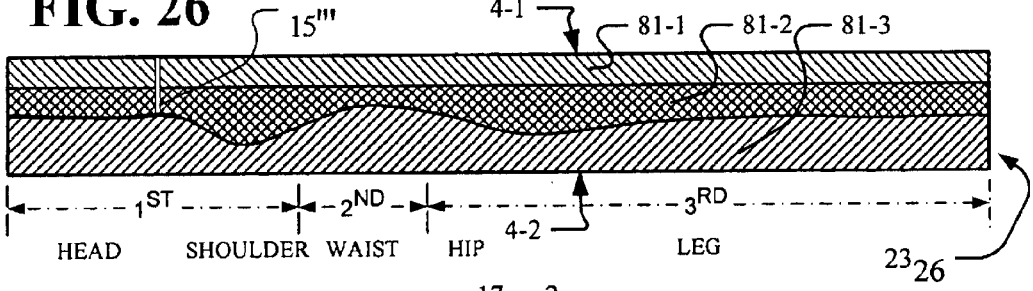
FIG. 26 depicts a side view of a mattress having a single top layer over two mating and variable thickness members designed for body alignment and low contact pressure of an average male reclining on his side.

FIG. 26 depicts a side view of a mattress $\mathbf{1}_{26}$ having a uniform resilient top member 81-1 over a resilient supporting means $\mathbf{23}_{26}$ formed of two mating and variable thickness members 81-2 and 81-3. The mattress $\mathbf{1}_{26}$ has a uniformly flat top surface 4-1 and a uniformly flat bottom surface 4-2. The mattress $\mathbf{1}_{26}$ is designed for body alignment and low contact pressure of typical male body.

In FIG. 26, the mattress $\mathbf{1}_{26}$ is typically supported by a conventional foundation, like foundation 26 in FIG. 1, on bottom surface 4-2. In the FIG. 26 embodiment, the resilient top member 81-1 constitutes a uniform top region below the top surface 4-1 for supporting and distributing the weight of a reclining body in cooperation with resilient supporting means $\mathbf{23}_{26}$. The top member 81-1 is formed, for example, by one or more layers of foam having uniform displacement parameters for providing a uniform supporting surface pressure to a reclining body. In one embodiment, the members 81-1, 81-2 and 81-3 have ILD's of 24R, 15R and 28HR, respectively, so that the members 81-1, 81-2 and 81-3 are firm, soft and firm, respectively.

In FIG. 26, the mattress $\mathbf{1}_{26}$ is formed of multiple members that extend in the XY-plane (a plane normal to the page of the drawing) to establish different displacement parameters that help determine the mattress compression in the longitudinal direction for alignment of the head, shoulder, waist, hip and leg parts of a reclining body at low supporting body surface pressure.

In one embodiment, the top member 81-1 and the resilient supporting means $\mathbf{23}_3$ have a lateral slot 15''' that extends through top member 81-1 from the top surface 4-1 to and partially through the resilient supporting means $\mathbf{23}_3$ to the top of a bottom member 81-3. The slot 15''' extends laterally across (in a direction normal to the page in FIG. 26 like the slot 15/15' in FIG. 15) the mattress $\mathbf{1}_{26}$. The slot 15''' functions to relieve tension forces in members 81-1 and 81-2 that would otherwise be created by shoulder depression into the mattress $\mathbf{1}_{26}$.

Figure 27:
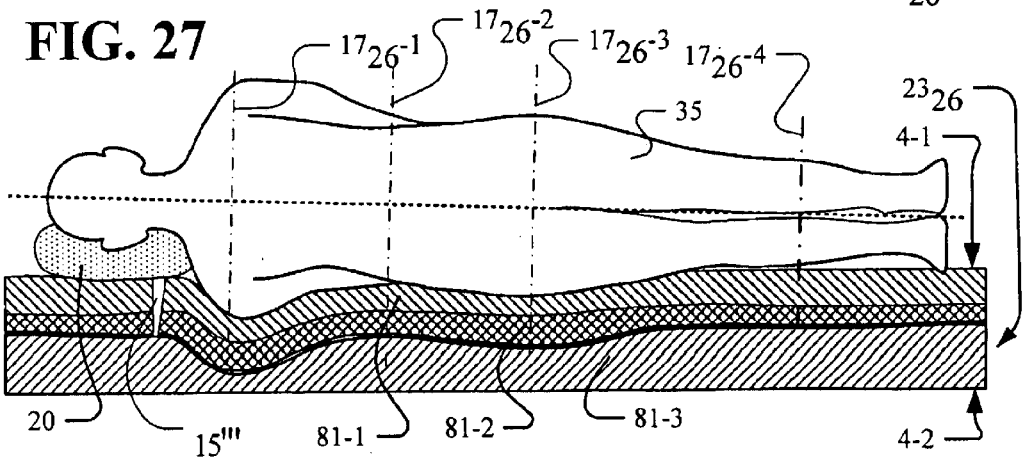
FIG. 27 depicts a side view of the mattress of FIG. 26 together with an average male reclining on his side.

FIG. 27 depicts a side view of the mattress $\mathbf{1}_{26}$ of FIG. 26 together with a male reclining on his side.

In FIG. 27, the resilient top member 81-1 has a top surface 4-1 that has been depressed by the body 35 so that it follows the curvature of the body. The top member 81-1 is in contact with the body (through a cover material like cover material 3 in FIG. 3) and functions to support and distribute the weight of the body in cooperation with resilient supporting means $\mathbf{23}_5$. The top member 81-1 is formed, for example, by one layer of constant thickness foam having uniform displacement parameters for providing a uniform supporting surface pressure to the reclining body 35. A pillow 20 is positioned under the head of body 35.

In a $1^{ST}$ region of mattress $\mathbf{1}_{26}$, the head section includes the foam members 81-1, 81-2 and 81-3 for supporting the head part of reclining body 35 where, in the uncompressed state (see FIG. 26), the firmer member 81-3 is the thickest and members 81-1 and 81-2 are about the same thickness. The foam members 81-1, 81-2 and 81-3 undergo only a small compression and provide appropriate displacement parameters for the head part of the side-lying male body 35. The shoulder section includes the foam members 81-1, 81-2 and 81-3 where, in the uncompressed state (see FIG. 26), the softer member 81-2 is the thickest. The foam members 81-1, 81-2 and 81-3 are substantially compressed by the shoulder of the reclining body 35. Together, in the shoulder region, the foam members 81-1, 81-2 and 81-3 provide appropriate displacement parameters for the shoulder part of the side-lying male body 35.

In a $2^{ND}$ region of mattress $\mathbf{1}_{26}$, the waist section includes the foam members 81-1, 81-2 and 81-3 for supporting the waist part of reclining body 35 where the softer member 81-2 is the thinnest and where, in the uncompressed state (see FIG. 26), the firmer member 81-3 is the thickest. Together, in the waist region, the foam members 81-1, 81-2 and 81-3 provide appropriate displacement parameters for the waist part of the side-lying male body 35.

In a $3^{RD}$ region of mattress $\mathbf{1}_{26}$, the hip section includes foam members 81-1, 81-2 and 81-3 for supporting the hip part of the reclining body 35 where, in the uncompressed state (see FIG. 26), the firmer member 81-3 is the thickest and members 81-1 and 81-2 are about the same thickness. Together, in the hip section, foam members 81-1, 81-2 and 81-3 provide appropriate displacement parameters for the hip part of the side-lying male body 35. In the leg section, foam members 81-1, 81-2 and 81-3 are for supporting the leg part of the reclining body 35 where, in the uncompressed state (see FIG. 26), the firmer member 81-3 is the thickest and members 81-1 and 81-2 are about the same thickness. Together, in the leg section, foam member 81-1, 81-2 and 81-3 provide appropriate displacement parameters for the leg part of the side-lying male body 35.

In FIG. 27, the shoulders have an alignment line $\mathbf{17}_{27}$-1, the waist has an alignment line $\mathbf{17}_{27}$-2, the hips have an alignment line $\mathbf{17}_{27}$-3, the legs have an alignment line $\mathbf{17}_{27}$-4 and the spine has an alignment line $\mathbf{18}_{27}$. In FIG. 27, the waist of the body is straight so the spine alignment line $\mathbf{18}_{27}$ is straight. The surface pressures between the body and the mattress at the shoulder alignment line $\mathbf{17}_{27}$-1, the waist alignment line $\mathbf{17}_{27}$-2, the hip alignment line $\mathbf{17}_{27}$-3 and the leg alignment line $\mathbf{17}_{27}$-4 are typically low and below a low pressure threshold. For a bed made of properly selected foams and other materials, the low pressure threshold is below the ischemic pressure of about 30 mmHg.

Figure 28:
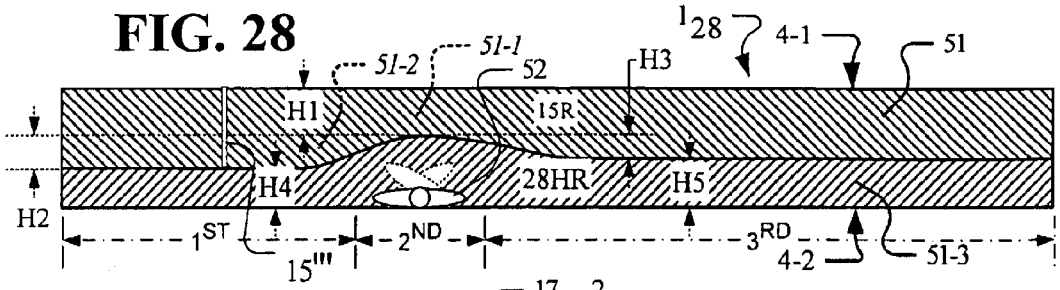
FIG. 28 depicts a side view of a mattress formed of two mating and variable thickness members designed for body alignment and low contact pressure of an average male reclining on his side.

FIG. 28 depicts a side view of a mattress $\mathbf{1}_{28}$ having a resilient top member 51 over a resilient supporting means $\mathbf{23}_{28}$. The resilient top member 51 in one embodiment is formed of a single foam layer of varying thickness. The top part 51-1 of the member 51 has a thickness H1 and the bottom part 51-2 has of thicknesses of H2 and H3 on either side of a raised contour section provided by bottom member 51-3. While the member 51 is shown as a single layer of variable thickness, the top part 51-1 and the bottom part 51-2 are similar to the two mating and variable thickness members 51-2 and 51-3 of FIG. 24. The bottom member 51-3 is a resilient means of variable thickness and has elevations H4 and H5 on either side of the raised contour section that has a elevation of H4+H2. Notwithstanding the variable elevation internal dimensions of the members 51 and 51-3, the mattress $\mathbf{1}_{28}$ has a uniformly flat top surface 4-1 and a uniformly flat bottom surface 4-2. The bottom surface of the resilient top member 51 and the top surface of the resilient means mate together to form an irregularly shaped internal interface between the resilient top member 51 and the resilient supporting means 51-3. The mattress $\mathbf{1}_{28}$ is designed for body alignment and low contact pressure of a typical male body. In the embodiment shown, the mattress $\mathbf{1}_{28}$ excluding any cover material is 10 inches high.

In one embodiment, the top member 51 has a lateral slot 15''' that extends through top member 51 from the top surface 4-1 to the top of the resilient supporting means 51-3. The slot 15''' extends laterally across (in a direction normal to the page in FIG. 28) the mattress $\mathbf{1}_{28}$. The slot 15''' functions to relieve tension forces that would otherwise be created by shoulder depression into the mattress $\mathbf{1}_{28}$.

Figure 29:
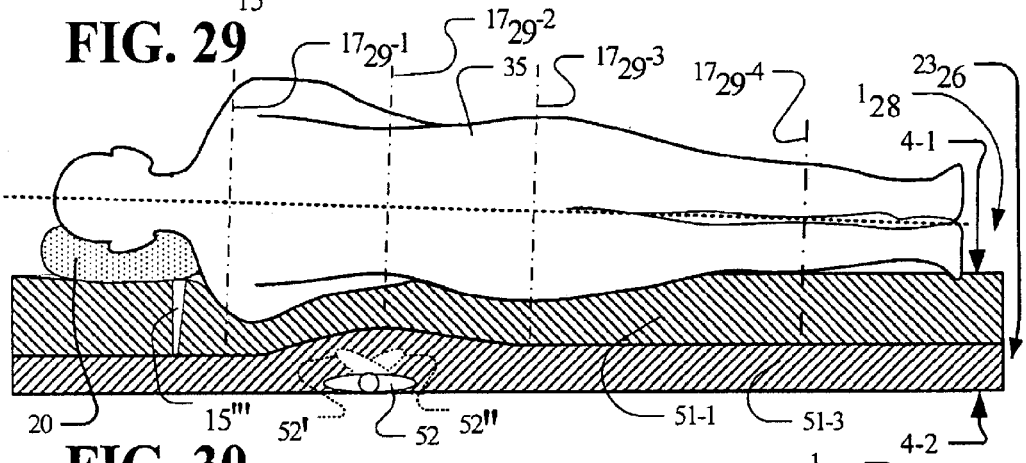
FIG. 29 depicts a side view of the mattress of FIG. 25 together with an average male reclining on his side.

FIG. 29 depicts a side view of the mattress $\mathbf{1}_{28}$ of FIG. 28 together with a male body 36 reclining on his side.

In FIG. 29, the resilient top member 51 has a top surface 4-1 that has been depressed by the body 36 so that it follows the curvature of the body. The top member 51 is in contact with the body and functions to support and distribute the weight of the body in cooperation with resilient supporting means 51-3. The top member 51-1 is formed by one layer of variable thickness foam having variable displacement parameters for providing a uniform supporting surface pressure to the reclining body 36. A pillow 20 is positioned under the head of body 36.

mattress at the shoulder alignment line $\mathbf{17}_{29}$-1, the waist alignment line $\mathbf{17}_{29}$-2, the hip alignment line $\mathbf{17}_{29}$-3 and the leg alignment line $\mathbf{17}_{29}$-4 are typically low and below a low pressure threshold. For a bed made of properly selected foams and other materials, the low pressure threshold is below the ischemic pressure of about 30 mmHg.

In FIG. 29, a mechanical lift member 52 is positioned in the waist region for tuning the waist region by providing elevation. When moved in on direction toward a position 52' shown dotted, the waist is lifted on the side more toward the shoulders and when moved in the other direction toward a position 52" shown dotted, the waist is lifted on the side more toward the hips. The inclusion of the lift 52 with the mattress $\mathbf{1}_{28}$ is optional. With or without lift 52, mattress $\mathbf{1}_{28}$ is economical to manufacture in that it includes only the two foam members 51 and 51-3 having, for example, ILD's of 15R and 28R, respectively.

Figure 30:
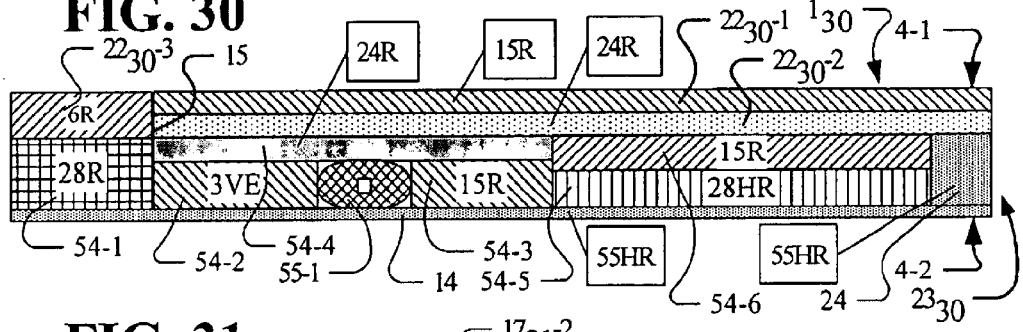
FIG. 30 depicts a side view of a mattress having one dynamic air-inflated adjusting member for tuning the mattress for body alignment and low contact pressure.

FIG. 30 depicts a side view of a mattress $\mathbf{1}_{30}$ having one dynamic adjusting member in the form of an air-inflated lift 55-1 for tuning the mattress $\mathbf{1}_{30}$ for body alignment and low contact pressure.

In the embodiment of FIG. 30, the mattress $\mathbf{1}_{30}$ of FIG. 30 has the displacement parameters established using the materials shown in the following TABLE 6.

TABLE 6

| Member | 54-1 | 54-2 | 54-3 | 54-4 | 54-5 | 54-6 | 14 | 24 | $22_{20}$-1 | $22_{20}$-2 | $22_{20}$-3 |
|---|---|---|---|---|---|---|---|---|---|---|---|
| IFD | 28R | 3VE | 15R | 24R | 28HR | 15R | 55HR | 55HR | 15R | 24R | 6R |
| Thickness | 6 in | 4 in | 4 in | 2 in | 3 in | 3 in | 1 in | 6 in | 2 in | 2 in | 4 in |

In a $1^{ST}$ region of mattress $\mathbf{1}_{28}$, the head section includes the foam members 51 and 51-3 for supporting the head part of reclining body 35 where, in the uncompressed state (see FIG. 28), the firmer member 51-3 is thinner, H4, and member 51 is thicker, H1+H2. The foam members 51 and 51-3, in the head region, undergo only a small compression and provide appropriate displacement parameters for the head part of the side-lying male body 35. The shoulder section is the same as the head section. The shoulder section and the head section are separated by the lateral slot 15'''.

In a $2^{ND}$ region of mattress $\mathbf{1}_{28}$, the waist section includes the foam members 51 and 51-3 for supporting the waist part of reclining body 35 where, in the uncompressed state (see FIG. 28), the softer member 51 is thinner, H1, and the firmer member 51-3 is thicker, H2+H4. Together, in the waist region, the foam members 51 and 51-3 provide appropriate displacement parameters for the waist part of the side-lying female body 35.

In a $3^{RD}$ region of mattress $\mathbf{1}_{28}$, the hip section includes foam members 51 and 51-3 for supporting the hip part of the reclining body 35 where, in the uncompressed state (see FIG. 28), the firmer member 51-3 is the thinnest, H5, and the softer member 51 is thicker, H3+H1. Together, in the hip section, foam members 51 and 51-3 provide appropriate displacement parameters for the hip part of the side-lying male body 35. The leg section is the same as the hip section.

In FIG. 29, the shoulders have an alignment line $\mathbf{17}_{29}$-1, the waist has an alignment line $\mathbf{17}_{29}$-2, the hips have an alignment line $\mathbf{17}_{29}$-3, the legs have an alignment line $\mathbf{17}_{29}$-4 and the spine has an alignment line $\mathbf{18}_{29}$-. In FIG. 29, the waist of the body is straight so the spine alignment line $\mathbf{18}_{29}$- is straight. The surface pressures between the body and the In TABLE 6 and FIG. 30, a resilient the top member $\mathbf{22}_{30}$ is formed by a composite of two members $\mathbf{22}_{20}$-1 and $\mathbf{22}_{20}$-2 and a member $\mathbf{22}_{20}$-3, where member $\mathbf{22}_{20}$-1 is 2 inches thick, member $\mathbf{22}_{30}$ is 2 inches thick and member $\mathbf{22}_{20}$-3 is 4 inches thick where member $\mathbf{22}_{20}$-1 is on top of member $\mathbf{22}_{20}$-2. The members $\mathbf{22}_{20}$-1 and $\mathbf{22}_{20}$-2 are separated from the member $\mathbf{22}_{20}$-3 by the lateral slot 15 to permit free depression by the shoulder of a body. With the dimensions of TABLE 2, the mattress $\mathbf{1}_{30}$ is 11 inches thick without accounting for the thickness of a covering (like the covering 3 of FIG. 3) which is approximately 2 inches so that the overall mattress $\mathbf{1}_{30}$ is approximately 13 inches thick and in standard widths and lengths.

Figure 31:
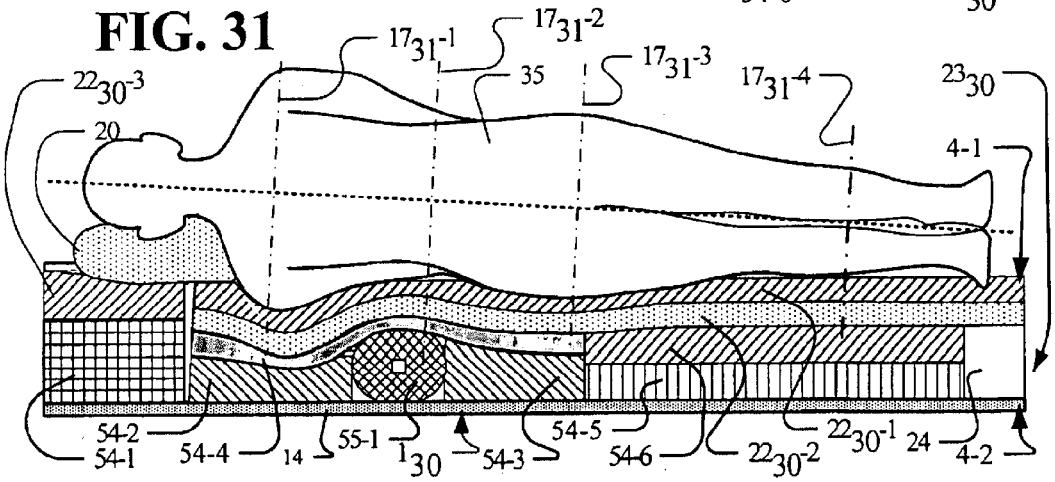
FIG. 31 depicts a side view of the mattress of FIG. 30 together with a male reclining on his side.

FIG. 31 depicts a side view of the mattress of FIG. 30 together with a male reclining on his side.

FIG. 31 depicts a side view of the mattress $\mathbf{1}_{30}$ formed of a resilient top member $\mathbf{22}_{30}$ and resilient supporting means $\mathbf{23}_{30}$. The resilient supporting means $\mathbf{23}_{30}$ includes one air-inflatable lift 55-1 for dynamically tuning the waist of mattress $\mathbf{1}_{30}$ for body alignment and low contact pressure.

In FIG. 31, the mattress $\mathbf{1}_{30}$ has atop surface 4-1 and a bottom surface 4-2 and the mattress $\mathbf{1}_{2}$ is supported by a conventional foundation 26. In the FIG. 31 embodiment, the member $\mathbf{22}_{30}$ constitutes a uniform top region below the top surface 4-1 for supporting and distributing the weight of a reclining body in cooperation with resilient supporting means $\mathbf{23}_{30}$. The top member $\mathbf{22}_{30}$ is formed, for example, by one or more layers of foam having uniform displacement parameters for providing a uniform supporting surface pressure to a reclining body.

The top member $\mathbf{22}_{30}$ and the resilient supporting means $\mathbf{23}_{30}$ have a lateral slot 15 that extends through top member $22_{30}$ from the top surface 4-1 to and partially through the resilient supporting means $23_{30}$ to a bottom member 14. The slot 15 extends laterally across (in a direction normal to the page in FIG. 31) the mattress $1_{30}$. The slot 15 functions to relieve tension forces that would otherwise be created by shoulder depression into the mattress $1_{30}$.

The foam members 54-1 and 54-2 are a head section of the mattress in a $1^{ST}$ region and for supporting the head part of a reclining body. The foam members 54-1 and 54- 2 are beneath the top member $22_{30}$-3. Together the top member $22_{30}$-3 and the foam members 54-1 and 54-2 provide appropriate displacement parameters for the head part of a reclining body.

The foam members 54-2 and 54-4 are a shoulder section of the mattress located beneath the foam member 54-4 and the top member $22_{30}$. Together the top member $22_{30}$ foam members 54-2 and 54-4 provide appropriate displacement parameters for the shoulder part of a reclining body. The lift 55-1 is in a waist section of the mattress located beneath the foam member 54-4 and are in turn beneath the top member $22_{30}$. The lift 55-1 is for adjusting the vertical elevations of mattress $1_{30}$ in the waist section. Together the top member $22_{30}$, lift 55-1 and foam member 54-4 provide appropriate displacement parameters for the waist part of a reclining body.

The foam members 54-3 and 54-4 are a hip section of the mattress located beneath the foam member 54-4 and the top member $22_{30}$. Together the top member $22_{30}$ foam members 54-3 and 54-4 provide appropriate displacement parameters for the hip part of a reclining body.

The foam members 54-5 and 54-6 are in a leg section of the mattress located beneath the top member $22_{30}$ and provide appropriate displacement parameters for the leg part of a reclining body.

The mattress $1_{30}$ includes a bottom foam member 14 which extends from the head of the mattress to the foot of the mattress 5-2' to provide a firm base for all the components of the resilient supporting means $23_{30}$. Additionally, surrounding a portion of the perimeter of the mattress $1_{30}$, preferable excluding the head of the mattress, is a firm foam member 24 which is shown partially broken away in FIG. 31. The foam member 24 functions to provide a firm outer edge for the mattress $1_{30}$. The firm foam member 24 renders the mattress comfortable for a person sitting on the edge of the bed. The mattress $1_{30}$ has a covering like covering 3 described in connection with FIG. 3.

Figure 32:
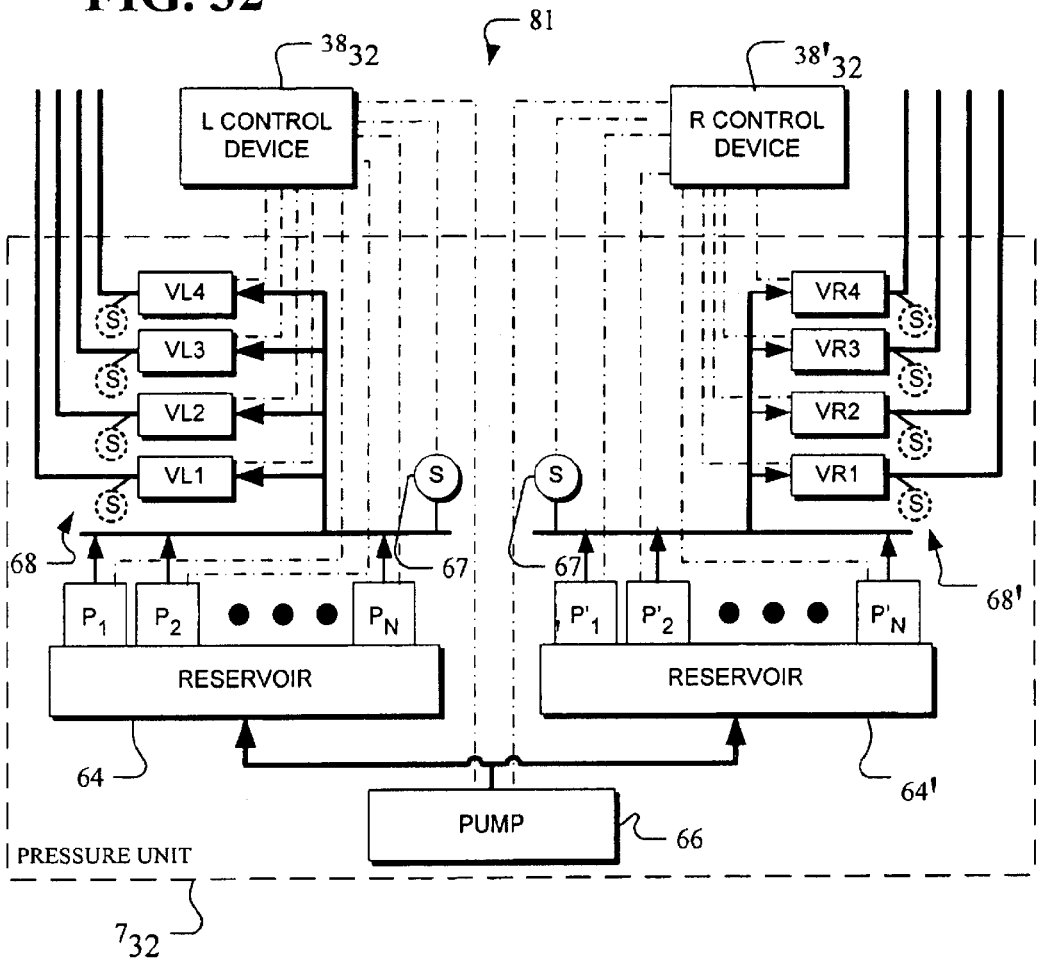
FIG. 32 depicts an alternate pressure unit like the pressure unit shown in FIG. 13.

FIG. 32 depicts an alternate control unit 81 as an alternate to the control unit $80_{13}$ of FIG. 13. In FIG. 32, the pressure unit $7_{32}$ is an alternate for the pressure unit 7 of FIG. 13. In FIG. 32, the left control device $38_{32}$ is for controlling the valves (VL) in the pressure unit $7_{32}$ to inflate or deflate the lifts 12 of a mattress such as shown in FIG. 5 where the lifts 12 include shoulder lift 12-1, waist lifts 12-2 and 12-3 and hip lift 12-4. Referring to FIG. 13 and FIG. 32, the shoulder lift 12-1 is controlled by the air valve (VL1) 37-1, the waist lift 12-2 is controlled by the air valve (VL2) 37-2, the waist-hip lift 12-3 is controlled by the valve (VL3) 37-3 and the hip lift 12-4 is controlled by the hip valve (VL4) 37-4. Each of the valves VL1 , VL2 , VL3 and VL4 is independently actuated by control device $37_{32}$. Each of the valves VL1, VL2 , VL3 and VL4 connects in common to pressure sources P1, P2, . . . , $P_N$ which are each in turn connected to pressure reservoir 64 supplied by common pump 66. The pressure sources P1, P2, . . . , $P_N$ each provide a different pressure level and each can be individually selected by control device $37_{32}$. Therefore, any one of the N pressures from pressure sources P1, P2, . . . , $P_N$ can be connected to any one of the lifts 12-1, 12-2, 12-3 and 12-4 under control of control device $38_{32}$. When so connected, the pressure sensor 67 senses the pressure of the connected lift and hence measures the pressure in each of the lifts at different times. Optionally, pressure sensors 68 are connected in the air lines between the valves VL and the corresponding lifts 12 for individually and continuously sensing the pressure in each lift 12.

In FIG. 32, the right control device $38'_{32}$ is for controlling the valves (RL) in the pressure unit $7_{32}$ to inflate or deflate the lifts 12' of FIG. 5 where the lifts include shoulder lift 12'-1, waist lifts 12'-2 and 12'-3 and hip lift 12'-4. Referring to FIG. 13 and FIG. 32, the shoulder lift 12'-1 is controlled by the air valve (RL1) 37'-1, the waist lift 12'-2 is controlled by the air valve (RL2 ) 37'-2, the waist-hip lift 12'-3is controlled by the valve (RL3) 37'-3 and the hip lift 12'-4 is controlled by the hip valve (RL4) 37'-4. Each of the valves RL1, RL2, RL3 and RL4 is independently actuated by control device $37'_{32}$. Each of the valves RL1, RL2, RL3 and RL4 connects in common to pressure sources P'1, P'2, . . . , $P'_N$ which are each in turn is connected to pressure reservoir 64' supplied by common pump 66. The pressure sources P'1, P'2, . . . , $P'_N$ each provide a different pressure level and each can be individually selected by control device $37'_{32}$. Therefore, any one of the N pressures from pressure sources P'1, P'2, . . . , $P'_N$ can be connected to any one of the lifts 12'-1, 12'-2, 12'-3 and 12'-4 under control of control device $37'_{32}$. When so connected, the pressure sensor 67' senses the pressure of the connected lift. Optionally, pressure sensors 68' are connected between the valves RL and the corresponding lifts 12' for individually and continuously sensing the pressure in each lift 12'.

In FIG. 32, the control of FIG. 32 provides independent left and right control for the mattresses of FIG. 13 and FIG. 14. While separate reservoirs 64 and 64' have been shown, a single common reservoir can be employed.

Figure 33:
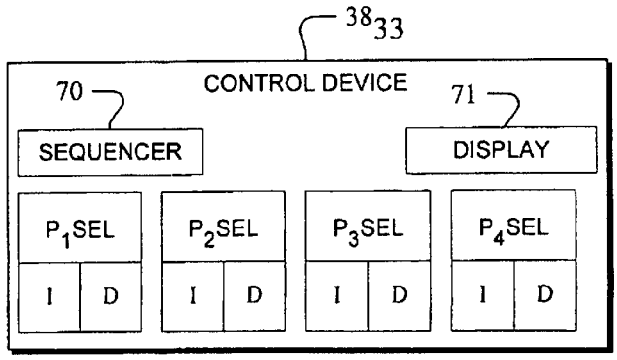
FIG. 33 depicts a typical hand actuated control device.

FIG. 33 depicts a hand-actuated control device $38_{33}$ that is typical of the control devices $38_{32}$ and $38'_{32}$ of FIG. 32. The control device $38_{33}$ includes a actuator $P_x$SEL for each of the lifts 12-1, 12-2, 12-3 and 12-4 in the case of the left control device $38_{32}$ including $P_1$SEL, $P_2$SEL, $P_3$SEL and $P_4$SEL and each operates to select any one of the pressure sources P1, P2, . . . , $P_N$. The selection can be for increasing pressure (I) or decreasing pressure (D). Control device $38_{33}$ includes a display 71 for displaying the pressure level in each of the lifts and for displaying other system information. Control device $38_{33}$ includes a sequencer 70 for automatic control of the pressures in the lifts of the mattress controlled. The sequencer 70 senses the actual pressures in the mattress and adjusts those pressures to preestablished levels. The preestablished levels are those selected by a person as adjusted from time to time or as default settings established by the manufacturer. The sequencer typically includes a momentary contact switch or other actuator that enables a person to preset or reset the pressure levels in all lifts to some desired pattern.

Figure 34:
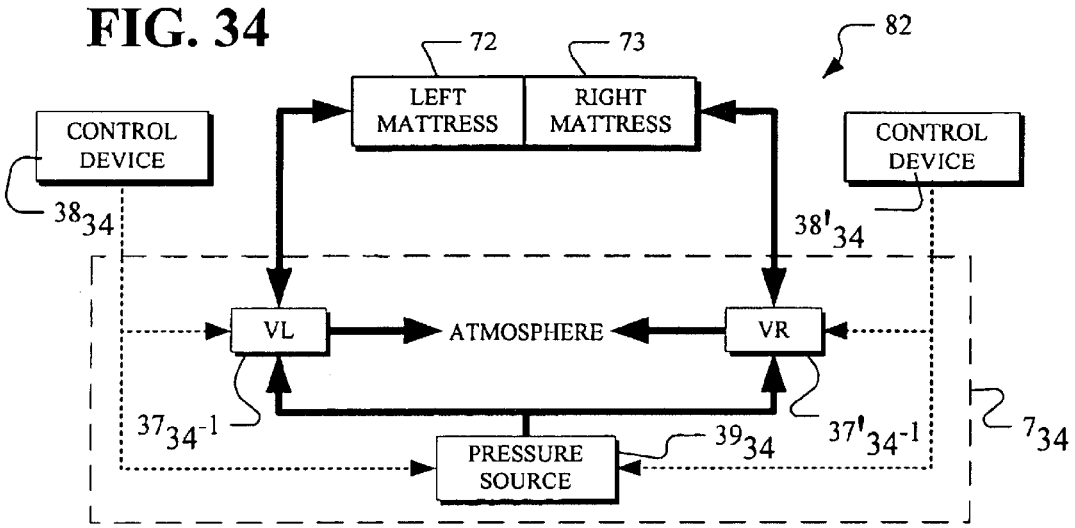
FIG. 34 depicts alternate pressure and control units like the pressure and control units shown in FIG. 13.

FIG. 34 depicts an alternate control unit 82 as an alternate to the control unit 80. In FIG. 34, the pressure unit $7_{34}$ is like the pressure unit 7 of FIG. 13. In FIG. 34, the left control device 3834 is for controlling the valve (VL) $37_{34}$-1 in the pressure unit $7_{34}$ to inflate or deflate the waist lift 55-1 of a mattress such as shown in FIG. 30 when used, for example, on the left side of a two-person bed. Referring to FIG. 34, the waist lift 55-1 is controlled by the air valve (VL) $37_{34}$-1. The left control device $38_{34}$ operates to increase or decrease the pressure in the left mattress 72. When a person desires increased pressure in the waist lift, left control device $38_{34}$ is actuated and pressure source $39_{34}$ supplies pressure through valve (VL) $37_{34}$-1 to left mattress 72. When a person desires decreased pressure in the waist lift, left control device $38_{34}$ is actuated and pressure valve (VL) $37_{34}$-1 vents air from the left mattress 72 to the atmosphere. Sensors like those shown in FIG. 32 can be used for the left mattress in FIG. 34.

In FIG. 34, the right control device $38'_{34}$ is for controlling the valve (VR) $37'_{34}$-1 in the pressure unit $7_{34}$ to inflate or deflate the waist lift 55-1 of a mattress such as shown in FIG. 30 when used on the right side of a two-person bed. Referring to FIG. 34, the waist lift 55-1 is controlled by the air valve (VL) $37'_{34}$-1. The left control device $38'_{34}$ operates to increase or decrease the pressure in the right mattress 73. When a person desires increased pressure in the waist lift, right control device $38'_{34}$ is actuated and pressure source $39_{34}$ supplies pressure through valve (VR) $37'_{34}$-1 to right mattress 73. When a person desires decreased pressure in the waist lift, right control device $38_{34}$ is actuated and pressure valve (VR) $37_{34}$-1 vents air from the right mattress 73 to the atmosphere. Sensors like those shown in FIG. 32 can be used for the right mattress in FIG. 34.

Figure 35:
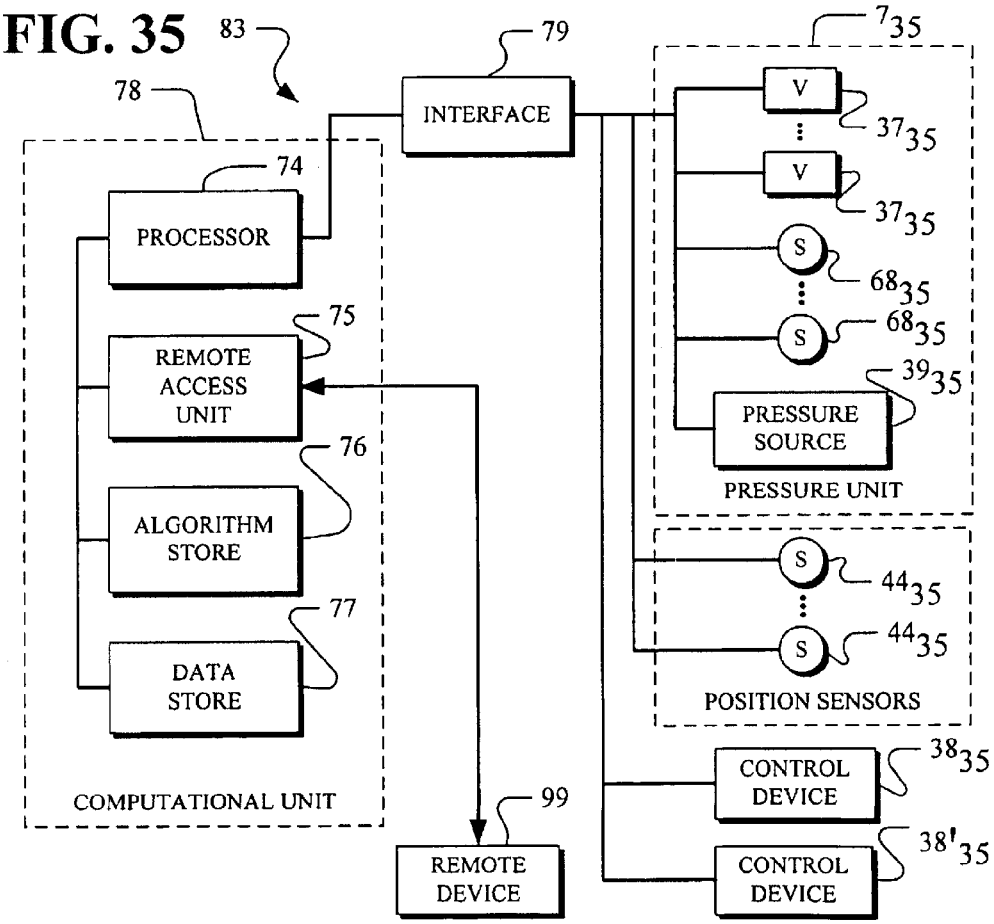
FIG. 35 depicts alternate pressure and control units like the pressure and control units shown in FIG. 13.

FIG. 35 depicts alternate control unit 83. The control unit 83 includes a computational unit 78, a pressure unit $7_{35}$, body sensors $44_{35}$ and control devices $38_{35}$ and $38'_{35}$. The computational unit 78 includes a processor 74, a remote access unit 75, a algorithm store 76 and a data store 77. The computational unit 78 is any general purpose computer or alternatively is a special purpose computer designed especially for mattress use and constructed with conventional computer components. The computational unit 78 is connected to the pressure unit $7_{35}$, the body sensors $44_{35}$ and the control devices $38_{35}$ and $38'_{35}$ through an interface 79. The pressure unit $7_{35}$ includes valves $37_{35}$, pressure sensors $68_{35}$ and a pressure source $39_{35}$. The body sensors $44_{35}$ are like the sensors 44 in FIG. 14. The remote access unit 75 connects to a remote device 99 which functions in various modes. In a remote data mode, the remote device collects data about the mattress conditions of lift pressure and body position and about the sleep patterns of persons using the mattresses on a bed. In a remote control mode, the remote device controls the pressure settings of the mattress.

In FIG. 35, two types of sensing devices are included in the control unit 83 for sensing pressure data and for sensing body data. The sensors $68_{35}$ are like the sensors 67, 67', 68 and 68' in FIG. 32 and sense pressure data including pressure in the lifts and other parts of the air equipment of a control unit. The sensors $44_{35}$ are like the sensors 44 in FIG. 14 and function to sense body data including position, movement and orientation of a body on the mattress.

The processor 74 executes algorithms for operations performed while a body is reclining on the mattress. The algorithms executed include a data recording algorithm, a pattern matching algorithm, a body motion algorithm, a mattress pressure algorithm and a sleep analysis algorithm. The data recording algorithm functions to periodically sense and record readings from the sensors $44_{35}$ and stores the readings as a sensed pattern in data store 77. The pattern matching algorithm functions to periodically compare a sensed pattern with recorded patterns. The body motion algorithm functions to periodically compare a current sensed pattern with a stored prior sensed pattern to determine body motion and position changes. The mattress pressure algorithm functions to periodically read the sensors $68_{35}$ and control the valves $37_{35}$ and the pressure source $39_{35}$ to adjust the pressure in the lifts and other parts of the air equipment. The sleep analysis algorithm functions to analyze sensed patterns, recorded patterns and changes in such information over one or more sleep periods to provide sleep information.

When a mattress is unoccupied, that is, no body is present, the control unit senses the low pressure values in sensors $68_{35}$ and senses the absence of body depressions by sensors $44_{35}$. When a body reclines on the mattress, the control unit senses the change from the unoccupied state and remains in a data sensing mode during an adjusting period when the body is adjusting position on the mattress. When the body has stabilized and motion is reduced, the control unit senses the size, weight and orientation (back, front, side and other) of the body in the different sections and adjusts the lift pressures to a recorded pattern, RP, for a body of the detected size, weight and orientation. The recorded patterns are initially default patterns that are set by the manufacturer as being satisfactory for a large percentage of the population for body alignment and low body surface pressure. However, the recorded patterns are updated by a person from time to time and the recorded pattern used for any particular size, weight and orientation is the latest updated value or other stored values that can be selected.

For a manual mode of operation, the sensors $44_{35}$, sense the body position and orientation and provide a sensed pattern, SP, that is stored in the data store 77 by processor 74. The sensed pattern is compared with recorded patterns and the best correlated recorded pattern is used to determine lift pressures. The processor 74 then transmits the appropriate lift pressure setting information through the interface to the pressure unit $7_{35}$ to cause the pressure source $39_{35}$ and the valves $37_{35}$ to inflate/deflate the lifts in conjunction with the lift pressure sensors $68_{35}$. A person at any time though use of a control device can manually increase or decrease the pressure in any lift.

For other modes of operation, the operation is similar to the manual operation. However, additional algorithms are employed to perform analysis and control functions. During the course of a sleep period, the quality of sleep is determined from the collected data by analysis of the duration that a body remains in particular positions, the frequency of change of position and other information about body movement and postural shifting during the sleep period. The mattress when used in hospital, sleep clinic and similar settings provides information through remote access unit 75 to a remote device 99. The remote device in some embodiments is at a central station in a hospital or clinic connected to beds in such facilities. Alternatively, the beds may be located in residences and any other locations and remote access unit 75 communicates via modem, internet or any other remote access means. Such remote access capability enables sleep studies to be conducted for a large population of sleepers in normal sleep settings outside of hospitals and clinics.

While the invention has been described in connection with different embodiments, still further and other embodiments are contemplated. The embodiments described in connection with FIGS. 2, 3, 19 and 30 (and related figures) include dynamically controllable lifts that adjust for the vertical displacement pattern, $E_Z$, of different bodies where $E_Z=f(x)$ where f(x) tracks the curve of any particular body. The lifts are used in combination with discrete foam members having different displacement parameters, DP, so that supporting force, $SF_Z$, is represented at any segment x in the X-axis direction by the local force, F(x), and the combined local displacement parameters, DP(x) where $SF_Z=F(x)\bullet DP(x)$.

The embodiments described in connection with FIGS. 20 and 21 employs discrete foam members that adjust for the vertical displacement pattern, $E_Z$, of different bodies where $E_Z$=f(x) where f(x) tracks the curve of any particular body. The discrete members used have different displacement parameters, DP, so that supporting force, $SF_Z$, is represented at any segment x in the X-axis direction by the local force, F(x), and the combined local displacement parameters, DP(x) where $SF_Z$=F(x)•DP(x). The members 49-1 and 49-2 in FIGS. 20 and 21 are reversed to change DP(x) to adjust for the difference between a male body and a female body.

The embodiments described in connection with FIGS. 24 through 29 employ continuous foam members such as 50-1, 50-2 and 50-3 that adjust for the vertical displacement pattern, $E_Z$, of different bodies where $E_Z$=f(x) where f(x) tracks the curve of any particular body. The continuous foam members used have different displacement parameters, DP, as a function of X-axis position (achieved by varying thickness) so that supporting force, $SF_Z$, is represented at any segment x in the X-axis direction by the local force, F(x), and the combined local displacement parameters, DP(x) where $SF_Z$=F(x)•DP(x).

The above embodiments have been described with displacement parameters, DP(x), that vary as a function of the X-axis position and which track the X-axis vertical elevation profile of a body as described in connection with FIGS. 7 and 8. Using displacement parameters, DP(x), that vary as a function of the X-axis position enable a mattress to be economically manufactured while at the same time providing an improved mattress that supports a reclining body in a comfortable alignment and with low surface pressure.

The present invention also applies to displacement parameters that vary as a function of the Y-axis position. As described in connection with FIG. 9, foam members have Y-axis displacement parameters that are essentially the same as X-axis parameters. Accordingly, any of the members providing different X-axis variations in displacement parameters can also me modified to provide Y-axis variations in displacement parameters. For example, the member 23-2$_1$ in FIG. 1, in an alternate embodiment, is segmented in the Y-axis direction as shown by the multiple segments 23'-2$_1$. A body, such as body 36 in FIG. 5, has a Y-axis profile at any X-axis location that is analogous to the X-axis profile of FIG. 7. The segments 23'-2$_1$ for mattress 1$_1$ have displacement parameters varying in the Y-axis direction. In one preferred embodiment, the Y-axis variation track the Y-axis vertical elevation profile of a reclining body. In such an embodiment, the displacement parameters, DP(x,y), vary as a function of the X-axis position (and preferably track the X-axis vertical elevation profile of a reclining body) and vary as a function of the Y-axis position (and preferably track the Y-axis vertical elevation profile of a reclining body).

Although the mattress embodiments described are capable of providing straight body alignment, the control of lifts, other mechanisms members permit a person to select any alignment whether straight or not. In general, a person by actuating a control device or by other means will select a comfortable alignment, that is, an alignment which is comfortable to that person irrespective of whether or not the comfortable alignment is actually straight postural alignment.

While the invention has been particularly shown and described with reference to preferred embodiments thereof it will be understood by those skilled in the art that various changes in form and details may be made therein without departing from the scope of the invention.

What is claimed is:

1. A mattress extending in a longitudinal direction, from a mattress head to a mattress foot, and extending in a lateral direction, normal to the longitudinal direction, for supporting a first reclining body, said body including a head part, a shoulder part, a waist part, a hip part and a leg part for reclining in the longitudinal direction with the head part toward the mattress head and the leg part toward the mattress foot, said mattress comprising, a resilient top member having a top region possessing uniform displacement parameters for providing a uniform supporting surface pressure to the reclining body, resilient supporting means below said top member, said resilient supporting means extending in said lateral direction and in said longitudinal direction with differing displacement parameters along the longitudinal direction for imparting differing vertical compressions along the longitudinal direction in the presence of said reclining body, said resilient supporting means for coacting with said top member for establishing alignment of the shoulder, waist and hip parts and for establishing low supporting surface pressure on the body, a cover for covering said resilient top member and said resilient supporting means without interfering with the displacement parameters and the vertical compressions when supporting said reclining body.

2. The mattress of claim 1 wherein said resilient supporting means includes resilient first, second and third regions wherein said second resilient region is for establishing second vertical elevations in a second region when aligned at said waist part, said first resilient region for establishing first vertical elevations in a first region extending longitudinally toward said mattress head from said second region, and said third resilient region for establishing third vertical elevations in a third region extending longitudinally from said second region toward said mattress foot.

3. The mattress of claim 1 wherein said resilient supporting means includes resilient first, second and third regions wherein said second region is for establishing waist displacement parameters when aligned at said waist part, said first region including a head section and a shoulder section for establishing head displacement parameters and shoulder displacement parameters and extending longitudinally toward said mattress head from said second region, and said third region including a hip section and a leg section for establishing hip displacement parameters and leg displacement parameters and extending longitudinally from said second region toward said mattress foot.

4. The mattress of claim 1 wherein said resilient supporting means includes a plurality of lifts extending laterally for establishing differing vertical elevations longitudinally along the body and where said mattress includes control means for controlling said lifts to control said vertical elevations.

5. The mattress of claim 4 wherein said control means includes pressure means for adjusting the pressure in said lifts and includes a control device for controlling said pressure means.

6. The mattress of claim 5 wherein said control device includes for each lift an increase pressure actuator and a decrease pressure actuator.

7. The mattress of claim 5 wherein said control device includes a display for displaying a pressure level for each lift.

8. The mattress of claim 5 wherein said control device includes a sequencer for controlling a sequence of operations by said control device.

9. The mattress of claim 5 wherein said control device is hand-actuated by said body.

10. The mattress as in claim 1 wherein said resilient top member extends under at least said shoulder part, said waist part and said hip part.

11. The mattress as in claim 1 wherein said resilient top member extends under at least said shoulder part, said waist part, said hip part and said leg part.

12. The mattress as in claim 1 wherein said resilient top member extends under said head part, said shoulder part, said waist part, said hip part and said leg part.

13. The mattress as in claim 1 wherein said resilient top member extends under said head part, said shoulder part, said waist part, said hip part and said leg part and includes a lateral slot between said head part and said shoulder part.

14. The mattress as in claim 1 where said resilient supporting means include an outside foam member having displacement parameters including a high indentation load deflection value, said outside foam member extending around a substantial portion of a perimeter of said mattress to provide a firm outside perimeter for said mattress.

15. The mattress as in claim 1 for supporting a reclining second body laterally beside said reclining first body, said resilient top member and resilient supporting means having a left side and a right side for said first body and said second body, respectively.

16. The mattress of claim 1 wherein said resilient supporting means includes a plurality of lifts extending laterally for establishing differing vertical elevations longitudinally along the body and where said mattress includes control means for controlling said lifts to control said vertical elevations, said control means including, a plurality of valves, one for each of said lifts, a pressure source connected to said valves, a control device for actuating said valves and said pressure source to increase or decrease the pressure in said lifts.

17. The mattress of claim 1 wherein said resilient supporting means includes a plurality of lifts extending laterally for establishing differing vertical elevations longitudinally along the body and where said mattress includes control means for controlling said lifts to control said vertical elevations, said control means including, a plurality of valves, one for each of said lifts, a pressure source connected to said valves, a control device for actuating said valves and said pressure source to increase or decrease the pressure in said lifts, one or more pressure sensors for sensing pressure data for representing pressure in said lifts, a plurality of body sensors arrayed laterally and longitudinally in said mattress for sensing body data representing the position and orientation of the body on said mattress.

18. The mattress of claim 17 wherein said control means further includes, computational means including a data store for storing pressure data and body data, an algorithm store for storing algorithms used for said mattress and a processor for executing said algorithms using said pressure data and said body data.

19. The mattress of claim 1 wherein said mattress includes control means including, a plurality of body sensors arrayed laterally and longitudinally in said mattress for sensing body data representing the position of the body on said mattress, computational means including a data store for storing said body data as a sensed pattern.

20. The mattress of claim 1 wherein said computational means further includes, an algorithm store for storing algorithms, a processor for executing said algorithms using said sensed pattern.

21. The mattress of claim 20 wherein, said data store stores recorded patterns of body data, said algorithm store stores a pattern matching algorithm, said processor executes said pattern matching algorithm to compare said sensed pattern with said recorded patterns to determine body parameters for said body.

22. The mattress as in claim 1 wherein said resilient supporting means includes lift means extending laterally for establishing a vertical elevation.

23. The mattress as in claim 22 wherein said lift is inflatable with a fluid.

24. The mattress as in claim 23 wherein said lift is inflatable with air and wherein said mattress includes pressure means for adjusting air pressure in said lift and includes a control device for controlling said pressure means to adjust said air pressure in said lift and thereby adjust the vertical elevation of said lift.

25. The mattress as in claim 22 wherein said resilient supporting means includes resilient first, second and third regions wherein said second region is for establishing waist displacement parameters when aligned at said waist part and wherein said second region includes one air-inflatable lift extending laterally for establishing a vertical elevation in said second region, said first region including a head section and a shoulder section for establishing head displacement parameters and shoulder displacement parameters and extending longitudinally toward said mattress head from said second region, and said third region including a hip section and a leg section for establishing hip displacement parameters and leg displacement parameters and extending longitudinally from said second region toward said mattress foot.

26. The mattress as in claim 22 wherein said head section is formed by a first head foam member over a second head foam member, said shoulder section is formed by a shoulder foam member, said waist section is formed by an air-inflatable lift, said hip section is formed by a hip foam member, said leg section if formed by a first leg foam member over a second leg foam member and wherein an integrating foam member extends over said shoulder foam member, said lift and said hip foam member.

27. The mattress as in claim 22 wherein said resilient supporting means includes a first waist lift and a second waist lift, said first waist lift and said second waist lift positioned side by side in the longitudinal direction and each extending laterally for establishing a vertical elevation in said second region to support said waist part in alignment of said body.

28. The mattress as in claim 27 wherein said first waist lift is closer to said mattress head than said second waist lift and where said first waist lift has a higher vertical elevation than a vertical elevation of said second waist lift whereby said mattress is suitable for alignment when said body is small.

29. The mattress as in claim 27 wherein said first waist lift is closer to said mattress head than said second waist lift and where said first waist lift has a lower vertical elevation than a vertical elevation of said second waist lift whereby said mattress is suitable for alignment when said body is large.

30. The mattress as in claim 22 wherein said resilient supporting means includes one or more lifts in said first region, one or more lifts in said second region and one lift in said third region, said lifts extending laterally for establishing differing vertical elevations in said first, second and third regions for aligning said body.

31. The mattress as in claim 22 wherein said resilient supporting means includes two lifts in said first region including a head lift under said head part and a shoulder lift under said shoulder part, includes two lifts in said second region under said waist part and includes one lift in said third region under said hip part, said lifts extending laterally for establishing differing vertical elevations in said first, second and third regions for aligning said body.

32. The mattress as in claim 22 wherein said resilient supporting means includes a plurality of lifts extending laterally for establishing differing vertical elevations longitudinally along the body.

33. The mattress as in claim 32 wherein said plurality of lifts includes a head lift and a shoulder lift for the first region, a waist lift for the second region and a hip lift for the third region.

34. The mattress as in claim 33 wherein said waist lift has a vertical elevation greater than a vertical elevation of said shoulder lift and greater than a vertical elevation of said hip lift whereby said waist part is elevated higher than said shoulder part and higher than said hip part for body alignment.

35. The mattress as in any one of claims 32, 33 and 34 wherein said lifts are inflatable.

36. The mattress as in any one of claims 32, 33 and 34 wherein said lifts are inflatable with air, said mattress includes pressure means for adjusting air pressure in said lifts and includes a control device for controlling said pressure means to adjust said air pressure in said lifts and thereby the vertical elevations of said lifts.

37. The mattress as in any one of claims 32, 33 and 34 including one or more foam members having foam displacement parameters, said one or more foam members located between said lifts and said top member whereby supporting forces applied by said lifts are transmitted as a function of the foam displacement parameters of the foam members to said resilient top member.

38. A mattress extending in a longitudinal direction, from a mattress head to a mattress foot, and extending in a lateral direction, normal to the longitudinal direction, for supporting a first reclining body, said body including a head part, a shoulder part, a waist part, a hip part and a leg part for reclining in the longitudinal direction with the head part toward the mattress head and the leg part toward the mattress foot, said mattress comprising, a resilient top member having a top region possessing uniform displacement parameters for providing a uniform supporting surface pressure to the reclining body, resilient supporting means below said top member, said resilient supporting means extending in said lateral direction and in said longitudinal direction with differing displacement parameters along the longitudinal direction for imparting differing vertical compressions along the longitudinal direction in the presence of said reclining body, said resilient supporting means including a plurality of foam members extending laterally for establishing said differing displacement parameters longitudinally along the body, said resilient supporting means for coacting with said top member for establishing alignment of the shoulder, waist and hip parts and for establishing low supporting surface pressure on the body, a cover for covering said resilient top member and said resilient supporting means without interfering with the displacement parameters and the vertical compressions when supporting said reclining body.

39. The mattress as in claim 38 wherein said resilient top member and said resilient supporting means include said foam members extending under said head part and said shoulder part and wherein said mattress includes a lateral slot between said head part and said shoulder part extending through said resilient top member for relieving tension forces that would otherwise be created by shoulder depression when supporting said reclining body.

40. The mattress as in claim 38 wherein said resilient top member and said resilient supporting means include said foam members extending under said head part and said shoulder part and wherein said mattress includes a lateral slot between said head part and said shoulder part extending through said resilient supporting means and said resilient top member for relieving tension forces that would otherwise be created by shoulder depression when supporting said reclining body.

41. The mattress as in claim 38 wherein said resilient top member extends under at least said shoulder part, said waist part and said hip part.

42. The mattress as in claim 38 wherein said resilient top member extends under at least said shoulder part, said waist part, said hip part and said leg part.

43. The mattress as in claim 38 wherein said resilient top member extends under said head part, said shoulder part, said waist part, said hip part and said leg part.

44. The mattress as in claim 38 wherein said resilient top member extends under said head part, said shoulder part, said waist part, said hip part and said leg part and includes a lateral slot between said head part and said shoulder part.

45. The mattress as in claim 38 wherein said top member includes a first foam member having first displacement parameters and a second foam member having second displacement parameters for providing said supporting surface pressure.

46. The mattress as in claims 38 wherein said top member includes a first foam member having first displacement parameters including a first indentation load deflection value and a second foam member having second displacement parameters including a second indentation load deflection value where said second indentation load deflection value is substantially greater than said first indentation load deflection value for providing said supporting surface pressure.

47. The mattress as in claim 38 wherein said top member includes a first foam member having a first displacement parameter including a first indentation load deflection value and wherein said resilient supporting means includes a second foam member having a second displacement parameter including a second indentation load deflection value where said second indentation load deflection value is substantially less than said first indentation load deflection value.

48. The mattress as in claim 38 where said resilient supporting means include an outside foam member having displacement parameters including a high indentation load deflection value, said outside foam member extending around a substantial portion of a perimeter of said mattress and extending to the top of said top member to provide a firm outside perimeter for said mattress.

49. The mattress as in claim 38 wherein one or more of said foam members are adhered together to increase the stability of said mattress.

50. The mattress as in claim 38 wherein said top member is foam having a varying thickness in the longitudinal direction so as to form a first vertical elevation pattern in the longitudinal direction and said resilient means includes a second foam member having a varying thickness in the longitudinal direction so as to form a second vertical elevation pattern in the longitudinal direction where said first vertical elevation pattern and said second vertical elevation pattern match.

51. The mattress as in claim 38 wherein said top member is foam having first displacement parameters and having a varying thickness in the longitudinal direction so as to form a first vertical elevation pattern in the longitudinal direction and said resilient means includes a second foam member having second displacement parameters and having a varying thickness in the longitudinal direction so as to form a second vertical elevation pattern in the longitudinal direction where said first vertical elevation pattern and said second vertical elevation pattern match and where said first displacement parameters are different than said second displacement parameters.

52. The mattress as in claim 51 wherein the first displacement parameters include a first indentation load deflection value and wherein the second displacement parameters include a second indentation load deflection value wherein said second indentation load deflection value is greater than said first indentation load deflection value.

53. The mattress as in claim 51 wherein a top surface of said top member is flat, wherein a bottom surface of said resilient means is flat and wherein a bottom surface of the top member and a top surface of said resilient means mate together to form an irregularly shaped internal interface between said resilient top member and said resilient supporting means.

54. The mattress in any one of the claims 51, 52, and 53 wherein said top member and said resilient supporting means include resilient first, second and third regions wherein said second region is for establishing second vertical elevations when aligned at said waist part, said first region for establishing first vertical elevations and extending longitudinally toward said mattress head from said second region, and said third region for establishing third vertical elevations and extending longitudinally from said second region toward said mattress foot.

55. The mattress as in claim 38 for supporting a reclining second body laterally beside said reclining first body, said resilient top member and resilient supporting means having a left side and a right side for said first body and said second body, respectively.

56. The mattress as in claim 55 having a longitudinal slot extending through said resilient top member and through at least a portion of said resilient means between said left side and said right side to provide isolation between said first body and said second body.

57. The mattress as in claim 56 wherein said left side and said right side are tuneable differently when said first body an said second body are different sizes.

58. The mattress as in claim 38 wherein one or more of said plurality of foam members is segmented for establishing differing displacement parameters laterally across the body.

59. The mattress as in claim 38 wherein said resilient supporting means is formed of discrete foam members aligned longitudinally in the X-axis direction where said discrete foam members have combined local displacement parameters, DP(x), that vary as a function of the X-axis position.

60. The mattress as in claim 38 wherein said resilient supporting means is formed of continuous foam members aligned longitudinally in the X-axis direction where said foam members have local displacement parameters, DP(x), that vary as a function of the X-axis position.

61. The mattress as in claim 60 wherein said continuous foam members vary in thickness in the X-axis direction.

62. The mattress in any one of claims 59, 60 and 61 wherein said displacement parameters vary as a function of the Y-axis position where the Y-axis is normal to the X-axis.

63. A mattress extending in a longitudinal direction, from a mattress head to a mattress foot, and extending in a lateral direction, normal to the longitudinal direction, for supporting a first reclining body, said body including a head part, a shoulder part, a waist part, a hip part and a leg part for reclining in the longitudinal direction with the head part toward the mattress head and the leg part toward the mattress foot, said mattress comprising, a resilient top member having a top region possessing uniform displacement parameters for providing a uniform supporting surface pressure to the reclining body, resilient supporting means below said top member, said resilient supporting means extending in said lateral direction and in said longitudinal direction with differing displacement parameters along the longitudinal direction for imparting differing vertical compressions along the longitudinal direction in the presence of said reclining body, said resilient supporting means including a plurality of foam regions extending laterally for establishing said differing displacement parameters longitudinally along the body, said resilient supporting means for coacting with said top member for establishing alignment of the shoulder, waist and hip parts and for establishing low supporting surface pressure on the body, a cover for covering said resilient top member and said resilient supporting means without interfering with the displacement parameters and the vertical compressions when supporting said reclining body.

* * * * *